US011788747B2

(12) United States Patent
Dockery

(10) Patent No.: US 11,788,747 B2
(45) Date of Patent: Oct. 17, 2023

(54) AIRFIELD SYSTEMS, DEVICES, AND METHODS

(71) Applicant: Aeolus Air Devices LLC, San Diego, CA (US)

(72) Inventor: Robert Dockery, San Diego, CA (US)

(73) Assignee: Aeolus Air Devices LLC, San Diego, CA (US)

( * ) Notice: Subject to any disclaimer, the term of this patent is extended or adjusted under 35 U.S.C. 154(b) by 0 days.

(21) Appl. No.: 17/937,075

(22) Filed: Sep. 30, 2022

(65) Prior Publication Data

US 2023/0146091 A1 May 11, 2023

Related U.S. Application Data

(60) Provisional application No. 63/263,843, filed on Nov. 10, 2021.

(51) Int. Cl.

| | |
|---|---|
| ***B01D 46/00*** | (2022.01) |
| ***B01D 46/46*** | (2006.01) |
| ***F24F 9/00*** | (2006.01) |
| ***F24F 8/10*** | (2021.01) |
| ***F24F 13/28*** | (2006.01) |

(52) U.S. Cl.
CPC . *F24F 9/00* (2013.01); *F24F 8/10* (2021.01)

(58) Field of Classification Search
CPC .. B01D 46/0043; B01D 46/46; B01D 46/444; F24F 9/00; F24F 8/10; F24F 8/108; F24F 13/28
USPC ..... 55/385.1, 385.2, 471–473
See application file for complete search history.

(56) References Cited

U.S. PATENT DOCUMENTS

| | | | | |
|---|---|---|---|---|
| 4,471,688 | A | 9/1984 | Smets | |
| 5,264,015 | A | 11/1993 | Matsui | |
| 5,441,279 | A | 8/1995 | Messina et al. | |
| 5,997,399 | A | 12/1999 | Szatmary | |
| 6,168,517 | B1 * | 1/2001 | Cook | F24F 13/04 55/467 |
| 6,595,429 | B1 | 7/2003 | Carlson et al. | |
| 8,728,208 | B2 * | 5/2014 | Langford | F24F 8/10 95/149 |
| 9,310,088 | B2 | 4/2016 | Melikov et al. | |
| 10,018,369 | B2 | 7/2018 | Kawano | |

(Continued)

FOREIGN PATENT DOCUMENTS

| | | | | |
|---|---|---|---|---|
| CN | 1997440 B | * | 5/2012 | Y02A 50/20 |
| CN | 111912040 A | * | 11/2020 | F24F 1/24 |

(Continued)

OTHER PUBLICATIONS

Search Report and Written Opinion in corresponding International Patent Application No. PCT/US2022/077394, dated Jan. 20, 2023, in 11 pages.

(Continued)

*Primary Examiner* — Minh Chau T Pham
(74) *Attorney, Agent, or Firm* — Knobbe, Martens, Olson & Bear, LLP

(57) ABSTRACT

Various systems, devices, and methods disclosed herein relate to airfield systems are disclosed. Some embodiments relate to generating airfield barriers with purified air, devices for generating air fields, methods of using such devices, and methods for manufacturing such devices.

20 Claims, 33 Drawing Sheets

(56) References Cited

U.S. PATENT DOCUMENTS

| | | | | |
|---|---|---|---|---|
| 2007/0180801 | A1* | 8/2007 | Paterson | F24F 8/192 55/471 |
| 2007/0293141 | A1 | 12/2007 | Sims | |
| 2015/0297771 | A1 | 10/2015 | Law et al. | |
| 2016/0001212 | A1* | 1/2016 | Miller | B01D 46/46 55/418 |
| 2016/0146485 | A1 | 5/2016 | Weening | |
| 2017/0333823 | A1 | 11/2017 | Eccarius | |

FOREIGN PATENT DOCUMENTS

| | | | |
|---|---|---|---|
| ES | 1259899 | | 2/2021 |
| ES | 1259899 | U | 2/2021 |
| GB | 2265213 | A | 9/1993 |
| JP | 2015-113747 | A | 6/2015 |
| KR | 1999-0038148 | U | 10/1999 |
| KR | 19990038148 | U | 10/1999 |
| KR | 10-2009-0111657 | A | 10/2009 |
| KR | 10-2014-0052258 | A | 5/2014 |
| WO | WO 2019/227830 | A1 | 12/2019 |
| WO | WO 2019227830 | A1 | 12/2019 |

OTHER PUBLICATIONS

Air Showers and Pass Thrus Unlimited, Inc., Air Showers & Pass Thrus Website Home Page, https://web.archive.org/web/20000413072706/http:/www.aspt.com/, Apr. 13, 2000, in 2 pages.

Air Showers and Pass Thrus Unlimited, Inc., Air Shower Catalog, https://airshower.com/PDFs/ASPT%20Catalog%209-9-2014.pdf, Sep. 9, 2014, in 7 pages.

Terra Universal, Inc. Product Catalog, https://www.terrauniversal.com,https://www.terrauniversal.com/product-catalogs/view/detail/id/5/, Sep. 2014, in 56 pages.

TMI International, LLC, Save-T® Air Curtains catalog, https://assets.nicnet.net/0596/Images/Air-Curtain-Catalog.pdf, 2016, in 28 pages.

Mars Air Systems, Air Curtain Product Catalog Fall 2021, https://www.marsair.com/Content/Downloads/Brochures/Plugin/Mars%20Product%20Catalog.pdf, Fall 2021, in 22 pages.

Mars Air Systems, Mars Air Systems Website Home Page, https://web.archive.org/web/20000620225707/http:/www.marsair.com/marshome.htm, Jun. 20, 2020, in 1 page.

Vevor, Air Curtain Door Air Curtain 2 Speeds 36-Inch Air Curtain Commercial Product, https://web.archive.org/web/20220522202947/https:/www.vevor.com/air-curtain-c_10375/36-super-power-industrial-air-curtain-1511cfm-2-speeds-w-2-limit-switch-1-2hp-p_010961488107, May 22, 2022, in 6 pages.

Berner International, Air Curtains (Air Doors) Products Home Page, https://web.archive.org/web/201502010700742/https:/berner.com/all-products/, Feb. 1, 2015, in 5 pages.

* cited by examiner

AIRFIELD SYSTEMS, DEVICES, AND METHODS

CROSS REFERENCE

This application claims priority benefit of U.S. Provisional Patent Application No. 63/263,843 filed Nov. 10, 2021, and titled, "AIRFIELD SYSTEMS," which is incorporated herein by reference in its entirety.

All applications for which a foreign or domestic priority claim is identified in the Application Data Sheet as filed with the present application are hereby incorporated by reference under 37 CFR 1.57.

FIELD

The disclosure relates generally to the field of airfield barriers. Specifically, the application relates to the field generating airfield barriers with purified air, devices for generating airfields, methods of using such devices, and methods for manufacturing such devices.

BACKGROUND

Infectious aerosols are generated by people who are infected with viruses or bacteria, including those having the common cold, influenza, and/or coronavirus infection. The aerosols from carriers of the infection may comprise a collection of pathogen-laden particles in air. These aerosol particles may deposit onto or be inhaled by others who are not infected causing new infections and for disease spread.

SUMMARY OF CERTAIN ASPECTS

Several embodiments disclosed herein pertain to airfield generating devices (e.g., airfield generators), methods of using the same, and methods for manufacturing the same. In several embodiments, these devices are useful in inhibiting or preventing the transmission of infectious diseases, pollutants, allergens, odors, etc. The prevention and/or reduction of transmission of infection and/or disease-causing aerosols is especially important in today's society. For example, the COVID-19 (the disease caused by the novel coronavirus SARS-CoV2) pandemic caused public activity to substantially halt in the United States and other countries around the world. The risks to health associated with SARS-CoV2 resulted in disruptions in normal daily life and caused a massive economic impact, resulting in mass layoffs and closures of businesses just a few weeks into the crisis. These shutdowns were especially detrimental to businesses where close interactions are the norm, such as restaurants, classrooms, libraries, etc. Several embodiments disclosed herein provide devices configured to address issues with the transmission of pathogens.

In several embodiments, the devices (e.g., airfield generators) disclosed herein generate an air barrier (e.g., an airfield) between subjects. In several embodiments, the air barrier comprises fast moving, clean air. In several embodiments, the air barrier separates one subject's air environment from a second subject's air environment. In several embodiments, the moving air in the generated air barrier captures and/or pushes contaminated aerosols from the first subject away from the second subject so that the second subject is not exposed to pathogens from the first subject. In several embodiments, the velocity of the air in the airfield is sufficiently high so as to substantially inhibit or prevent aerosols and/or pathogens from breath, sneezes, and/or coughs from passing through the airfield. In several embodiments, the velocity of the air in the airfield is sufficiently high so as to reduce to a safe and/or non-transmissible level aerosols and/or pathogens from breath, sneezes, and/or coughs from passing through the airfield. In several embodiments, the velocity of the air in the airfield is sufficiently high so as to reduce particulate levels in aerosols and/or pathogens from breath, sneezes, and/or coughs from passing through the airfield.

In several embodiments, the airfield generator may be supplied with clean air from an outside source of clean air (e.g., an air tank, etc.). Alternatively, in several embodiments, the airfield generator is adapted to generate clean air from contaminated air to generate the airfield and a clean air environment. For example, in several embodiments, the airfield generator may be equipped with one or more filters configured to remove pathogens from the air. These filters may be used to generate clean and/or pure air that is accelerated by the airfield generator to produce the airfield barrier. For example, the airfield generator may be configured to use recycled air from a room in which the airfield generator is located to generate the airfield. As will be appreciated, the airfield generator may also act as a whole room air purifier. As illustration, in several embodiments, the airfield generator may be configured to pull air from the room in which the airfield generator resides into an air intake of the airfield generator, to filter and/or purify the air, to accelerate the air to a velocity sufficient to provide an airfield, and to expel the air as an airfield through an outlet of the airfield generator. In several embodiments, the air of the airfield circulates back into the airfield generator for recycling, cleaning, and continued generation of the airfield. Alternatively or additionally, the airfield generator may be configured to work with an existing HVAC system for buildings or rooms. For example, the airfield generator may acquire air from a supply vent of an HVAC system in an existing room and may be configured to direct exhaust air (e.g., from the airfield) to an air intake vent for the HVAC system in the room.

In several embodiments, advantageously, the airfield generator is compact, modular, and/or portable. In several embodiments, the airfield generator is configured to be installed as part of a structure (and/or to be retrofitted to a structure) without effecting the normal use of the structure. In several embodiments, the airfield generator is configured to attach to and/or inhibit or prevent the transmission of pathogens across structures. In several embodiments, the structures may include tables, desks, cubbies, workstations, etc. In several embodiments, when adapted to be used with a particular structure (such as a desk, table, etc.), the airfield generator is compact enough to provide little or no interference with the space beneath the structure (e.g., the leg space under the desk or table).

Existing wind-generating units (e.g., motors, fans, etc.) that are sufficiently powerful to provide adequate velocity of air to be used as an airfield are unacceptably noisy. The noise level generated inhibits or prevents the use of such wind-generating units in situations where the use of airfield generator would be desired. For example, excessive noise in a restaurant or classroom is not desirable and inhibits or prevents subjects from engaging in conversations at normal volume levels (about 60-70 dB). In several embodiments, advantageously, the airfield generator comprises one or more sound dampening features that absorb sound generated from the wind-generating unit (e.g., motor and/or fan) of the airfield generator. In several embodiments, the dampening feature reduces the noise level of the wind generating unit by equal to or at least about: 10 dB, 20 dB, 30 dB, 40 dB, 50 dB, or ranges including and/or spanning the aforementioned values.

In several embodiments, the airfield generator comprises a housing. In several embodiments, the airfield generator housing is configured to engage a filter system. In several embodiments, the airfield generator housing comprises a base. In several embodiments, the base comprises at least one air intake, an internal cavity providing an air passage through the base, and a filter system housing. In several embodiments, the filter system housing is provided within the air passage. In several embodiments, the airfield generator housing comprises or further comprises an outlet. In several embodiments, the outlet comprises an upwardly directed opening configured to generate an airfield. In several embodiments, the outlet is in fluid communication with the air passage of the base. In several embodiments, the airfield generator comprises a motor. In several embodiments, the motor is positioned at least partially within the internal cavity. In several embodiments, the motor is configured to generate an air flow from an ambient environment surrounding the airfield generator. In several embodiments, the motor generates airflow through the filter system and out of the airfield generator via the outlet of the housing thereby generating an airfield. In several embodiments, the airfield generated by the outlet provides a barrier (e.g., airfield) between a first side of the airfield and a second side of the airfield. In several embodiments, the airfield is configured to inhibit passage of aerosol particles through the airfield from the first side of the airfield to the second side of the airfield.

Any of the embodiments described above, or described elsewhere herein, can include one or more of the following features. No features are essential or critical.

In several embodiments, the airfield generator comprises the filter system while in other embodiments the filter system is separate from the airfield generator. In several embodiments, the filter system is configured to be engageable with the housing. In several embodiments, the filter system is configured to filter air passing into the airfield generator via the at least one air intake and through the airfield generator via the air passage.

In several embodiments, the outlet of the housing extends between a first side of the housing and a second side of the housing. In several embodiments, the outlet is a shape appropriate to generate first and second air environments that are substantially separated from one another by the airfield. In several embodiments, the outlet is a shape appropriate to generate air of sufficient velocity to provide the airfield. In several embodiments, the outlet has a dimension in one direction that is larger than its direction in a second direction. For example, in several embodiments, the outlet has a length measured in a direction proximal to one side of the housing and extending distally to a second side of the housing. In several embodiments, the outlet also has a width. In several embodiments, the length of the outlet is greater than its width. In several embodiments, the ratio of the length of the outlet to the width of the outlet is equal to or at least about: 30:1, 20:1, 15:1, 10:1, 15:2, 5:1, 5:2, and ratios between the aforementioned ratios. In several embodiments, the length of the outlet runs along a width of an object for which separate air environments are desired. For example, in several embodiments the length of the outlet is placed along the width of a table separating two equal or non-equal portions of the table along the length of the table. In several embodiments, when users are seated at the heads of the table, the airfield provides a separation between the air environment of the subjects. In several embodiments, the outlet may comprise one or more fins (e.g., adjustable or nonadjustable fins). In several embodiments, adjustable fins may allow a user to direct the air of the airfield in a particular direction (e.g., away from a particular user, toward a vent intake of the room, etc.).

In several embodiments, the filter system comprises a plurality of filters. In several embodiments, the plurality of filters comprises at least a first filter and a second filter. In several embodiments, the first filter has a first parameter and the second filter has a second parameter. In several embodiments, the first parameter is different than the second parameter. In several embodiments, the first parameter and the second parameter comprise at least one of a filter size, a filtering capacity, or a filter shape. In several embodiments, the air intake of the airfield generator comprises a first and a second air intake. In several embodiments, the first filter is configured to engage with a first filter housing of the airfield generator housing and is configured to filter a first portion of air traveling into the base through the first air intake. For example, the first filter may engage a first filter dock of the housing. In several embodiments, the second filter is configured to engage with a second filter housing of the base, the second filter being configured to filter a second portion of air traveling into the base through the second air intake.

In several embodiments, the internal cavity of the base extends widthwise between a first side of the housing (or a corresponding first side of the base) and a second side of the housing (or corresponding second side of the base) providing a width of the internal cavity. In several embodiments, the internal cavity has a length that extends through the base from an entrance to an exit of the internal cavity. In several embodiments, the first filter is proximal to the entrance of the internal cavity. In several embodiments, the second filter is proximal to the exit of the internal cavity.

In several embodiments, the length of the outlet of the housing spans (or substantially spans) the width of the internal cavity and/or air passage of the base. In several embodiments, the length of the outlet is greater than the width of the internal cavity. In several embodiments, the length of the outlet is approximately the same size as the width of the internal cavity. In several embodiments, the ratio of the length of the outlet to the width of the internal cavity is equal to or at least about: 2:1, 3:2, 4:3, 5:4, 6:5, 1:1, or ratios between the aforementioned ratios.

In several embodiments, the second filter is a polygonal filter having a filtering portion extending along a length of the second filter between a proximal end portion and a terminal end portion. In several embodiments, the proximal end portion and the terminal end portion are a corresponding polygonal shape visible when viewed along the length of the second filter (e.g., a triangular shape, square shape, pentagonal shape, hexagonal shape, etc.). In several embodiments, the length of the second air filter is sufficient to span the width of the internal cavity and/or air passage of the housing. In several embodiments, the second filter housing is polygonal in shape (e.g., having a triangular shape, a square shape, a pentagonal shape, a hexagonal shape, etc.). In several embodiments, the polygonal shape of the second filter housing corresponds to the polygonal shape of the polygonal filter. In several embodiments, the polygonal shape of the second filter housing is apparent when viewing the base from its side. In several embodiments, the second filter housing is configured to receive the second filter through a filter housing aperture. In several embodiments, the filter housing aperture is polygonal. In several embodiments, the second filter may be slide into the second filter housing through the width of the base. In several embodiments, when placed in the second filter housing, the second filter spans the internal cavity such that air traveling through the second air intake is forced through the second filter and into the internal cavity.

In several embodiments, the second filter comprises at least a first side, a second side, and a third side defined by vertices of the polygonal shape, wherein the first side defines a first filtering surface of the filtering portion of the second filter, and wherein the second side defines at least a second filtering surface of the filtering portion of the second filter. In several embodiments, as air passes through the second filter, the air flows through at least the first filtering surface and/or the second filtering surface of the second filter. In several embodiments, the second filter comprises a triangular pocket filter. In several embodiments, the filter system comprises a triangular pocket filter.

In several embodiments, the housing comprises a first engagement mechanism, wherein the filter system comprises a second engagement mechanism, and wherein the first engagement mechanism is configured to removably receive the second engagement mechanism to removably engage the filter system with the housing.

In several embodiments, the motor comprises an electric motor, such as an inductive motor. The motor can comprise a fixed or variable speed motor. In some embodiments, the motor operates on AC power and in other embodiments the motor operates on DC power. In several embodiments, the motor is configured to generate an air flow of at least 370 cubic feet per minute. In several embodiments, the motor is configured to generate an air flow of equal to or at least about: 100 cubic feet per minute, 250 cubic feet per minute, 350 cubic feet per minute, 400 cubic feet per minute, 450 cubic feet per minute, 500 cubic feet per minute, 650 cubic feet per minute, 750 cubic feet per minute, 1000 cubic feet per minute, or ranges including and/or spanning the aforementioned values. For example, in several embodiments, the motor is configured to generate an air flow ranging from 100 cubic feet per minute to 1000 cubic feet per minute, from 350 cubic feet per minute to 400 cubic feet per minute, from 350 cubic feet per minute to 750 cubic feet per minute, etc.

In several embodiments, the upwardly directed opening is substantially vertical and/or is configured to direct air in a substantially vertical direction. In several embodiments, the outlet comprises a nozzle being configured to alter an air flow angle of the upwardly directed opening relative to a vertical direction. In several embodiments, the nozzle is configured to alter the air flow angle between 0 degrees and 45 degrees relative to the vertical direction.

In several embodiments, the housing is configured to seal the internal cavity.

In several embodiments, the airfield generator further comprises a sterilization system (e.g., other than the filter system). In several embodiments, the sterilization system is configured to sterilize at least one of the housing, the motor, the filter system housing or the filter system.

In several embodiments, the airfield generator further comprises at least one noise attenuation element. In several embodiments, the noise attenuation element is configured to reduce noise produced by the airfield generator.

In several embodiments, the housing is positioned on a support structure, and wherein the airfield generator is configured to generate the airfield such that the upwardly directed opening is angled relative to a top surface of the support structure.

In several embodiments, the airfield is generated using air from at least one of the first side of the airfield, the second side of the airfield, or both.

In several embodiments, the airfield generator is configured to reduce transmission of particulates sized 0.3 to 1 micron in the air at an efficiency of at least 75%, 80%, 90%, 95%, 97.5%, 99%, or 99.9%. In several embodiments, the airfield generator is configured to transmission of reduce particulates sized greater than 1 micron in the air at an efficiency of at least 75%, 80%, 90%, 95%, 97.5%, 99%, or 99.9%. In several embodiments, the particle reduction efficiency is accomplished at a flow rate of 100 cubic feet per minute, 250 cubic feet per minute, 350 cubic feet per minute, 400 cubic feet per minute, 450 cubic feet per minute, 500 cubic feet per minute, 650 cubic feet per minute, 750 cubic feet per minute, 1000 cubic feet per minute, or ranges including and/or spanning the aforementioned values. In several embodiments, the efficiency of reduction of particulate transmission may be measured across a given distance between a first point (where the particulate is generated) and a second point (where the amount of particulate is measured). To measure efficiency, the amount of particulate is measured at the second point in a system lacking an airfield generator. This amount of particulate is then compared to the amount of particulate measured at the second point in a second system having an airfield generator separating the first and second points. In several embodiments, the reduction in particle transmission includes particles generated from breath during respiration, talking, coughing, and/or sneezing.

In several embodiments, the airfield generator is configured to reduce incidences of infectious disease transfer, and wherein the infectious diseases is a common cold, influenza, and/or COVID.

Several embodiments pertain to an airfield generator comprising a housing comprising a base and an outlet. In several embodiments, the airfield generator comprises a first filter being configured to filter air passing through the first filter, the first filter comprises a first parameter. In several embodiments, the airfield generator comprises a second filter being configured to filter air passing through the second filter, the second filter comprising a second parameter, the second parameter being different than the first parameter. In several embodiments, the airfield generator comprises a motor being positioned at least partially within the housing. In several embodiments, the motor is configured to generate air flow from an ambient environment, through at least one of the first filter or the second filter, and through the outlet of the housing to generate an airfield, the airfield comprising air flow of filtered air traveling in an upward direction from the outlet of the housing.

In several embodiments, the first parameter and the second parameter comprise at least one of a filter size, a filtering capacity, or a filter shape. In several embodiments, the first filter is configured to engage with a first filter housing and is configured to filter air traveling into the base through a first air intake of the first filter housing. For example, the first filter may engage a first filter dock of the housing. In several embodiments, the second filter is configured to engage with a second filter housing of the base, the second filter being configured to filter air traveling into the base through a second air intake of the second filter housing.

In several embodiments, the second filter is a polygonal filter having a filtering portion extending along a length of the second filter between a proximal end portion and a terminal end portion. In several embodiments, the second filter comprises at least a first side, a second side, and a third side defined by vertices of the polygonal shape, wherein the first side defines a first filtering surface of the filtering portion of the second filter, and wherein the second side defines at least a second filtering surface of the filtering portion of the second filter. In several embodiments, as air passes from the base to the outlet through the second filter, the air flows through at least the first filtering surface and/or the second filtering surface of the second filter. In several embodiments, the second filter comprises a triangular pocket filter. In several embodiments, the filter system comprises a triangular pocket filter.

In several embodiments, the housing comprises a first engagement mechanism, wherein the filter system comprises a second engagement mechanism, and wherein the first engagement mechanism is configured to removably receive the second engagement mechanism to removably engage the filter system with the housing.

In several embodiments, the motor comprises an inductive motor. In several embodiments, the motor is configured to generate an air flow of at least 370 cubic feet per minute.

In several embodiments, the upwardly directed opening is substantially vertical and/or is configured to direct air in a substantially vertical direction. In several embodiments, the outlet comprises a nozzle being configured to alter an air flow angle of the upwardly directed opening relative to a vertical direction. In several embodiments, the nozzle is configured to alter the air flow angle between 0 degrees and 45 degrees relative to the vertical direction.

In several embodiments, the housing is configured to seal the internal cavity.

In several embodiments, the airfield generator further comprises a sterilization system (e.g., other than the filter system). In several embodiments, the sterilization system is configured to sterilize at least one of the housing, the motor, the filter system housing or the filter system.

In several embodiments, the airfield generator further comprises at least one noise attenuation element. In several embodiments, the noise attenuation element is configured to reduce noise produced by the airfield generator.

In several embodiments, the housing is positioned on a support structure, and wherein the airfield generator is configured to generate the airfield such that the upwardly directed opening is angled relative to a top surface of the support structure.

In several embodiments, the airfield is generated using air from at least one of the first side of the airfield, the second side of the airfield, or both.

In several embodiments, the airfield generator is configured to reduce particulates sized 0.3 to 1 micron in the air at an efficiency of at least 75%, 80%, 90%, 95%, 97.5%, 99%, or 99.9%. In several embodiments, the airfield generator is configured to reduce particulates sized greater than 1 micron in the air at an efficiency of at least 75%, 80%, 90%, 95%, 97.5%, 99%, or 99.9%. In several embodiments, the particle reduction efficiency is accomplished at a flow rate of 100 cubic feet per minute, 500 cubic feet per minute, 650 cubic feet per minute, 1000 cubic feet per minute, 1500 cubic feet per minute, 2000 cubic feet per minute, 5000 cubic feet per minute, 7500 cubic feet per minute, or ranges including and/or spanning the aforementioned values.

In several embodiments, the airfield generator is configured to reduce incidences of infectious disease transfer, and wherein the infectious diseases is a common cold, influenza, and/or COVID.

Several embodiments pertain to an airfield generator comprising airfield generator comprising a housing comprising a base and an outlet. In several embodiments, the airfield generator comprises a filter being configured to filter air passing through the filter. In several embodiments, the airfield generator comprises an inductive motor being positioned at least partially within the housing, the motor being configured to generate air flow from an ambient environment, through the filter, and through the outlet of the housing to generate an airfield, the airfield comprising an airflow of filtered air traveling in an upward direction from the outlet of the housing.

In several embodiments, the filter is one of a plurality of filters. In several embodiments, the filter is a first filter and the plurality of filters comprises at least a second filter, the first filter having a first parameter, the second filter having a second parameter, and wherein the first parameter is different than the second parameter.

In several embodiments, the first parameter and the second parameter comprise at least one of a filter size, a filtering capacity, or a filter shape. In several embodiments, the first filter is configured to engage with a first filter housing and is configured to filter air traveling into the base through a first air intake of the first filter housing. For example, the first filter may engage a first filter dock of the housing. In several embodiments, the second filter is configured to engage with a second filter housing of the base, the second filter being configured to filter air traveling through a second air intake of the second filter housing.

In several embodiments, the second filter is a polygonal filter having a filtering portion extending along a length of the second filter between a proximal end portion and a terminal end portion. In several embodiments, the second filter comprises at least a first side, a second side, and a third side defined by vertices of the polygonal shape, wherein the first side defines a first filtering surface of the filtering portion of the second filter, and wherein the second side defines at least a second filtering surface of the filtering portion of the second filter. In several embodiments, as air passes through the second filter, the air flows through at least the first filtering surface and/or the second filtering surface of the second filter. In several embodiments, the second filter comprises a triangular pocket filter. In several embodiments, the filter comprises a triangular pocket filter.

In several embodiments, the housing comprises a first engagement mechanism, wherein the filter comprises a second engagement mechanism, and wherein the first engagement mechanism is configured to removably receive the second engagement mechanism to removably engage the filter with the housing.

In several embodiments, the airfield generator further comprises a cooling system to cool the motor. In several embodiments, the motor is configured to generate an air flow of at least 370 cubic feet per minute. In several embodiments, the motor is configured to generate an air flow of equal to or at least about: 100 cubic feet per minute, 250 cubic feet per minute, 350 cubic feet per minute, 400 cubic feet per minute, 450 cubic feet per minute, 500 cubic feet per minute, 650 cubic feet per minute, 750 cubic feet per minute, 1000 cubic feet per minute, or ranges including and/or spanning the aforementioned values.

In several embodiments, the upward direction is substantially vertical.

In several embodiments, the upwardly directed opening is substantially vertical and/or is configured to direct air in a substantially vertical direction. In several embodiments, the outlet comprises a nozzle being configured to alter an air flow angle of the upwardly directed opening relative to a vertical direction. In several embodiments, the nozzle is configured to alter the air flow angle between 0 degrees and 45 degrees relative to the vertical direction.

In several embodiments, the housing is configured to seal the internal cavity.

In several embodiments, the airfield generator further comprises a sterilization system (e.g., other than the filter system). In several embodiments, the sterilization system is configured to sterilize at least one of the housing, the motor, and the filter (e.g., the first or second filter). In several embodiments, the sterilizing system may comprise, for example, a UV light.

In several embodiments, the airfield generator further comprises at least one noise attenuation element. In several embodiments, the noise attenuation element is configured to reduce noise produced by the airfield generator.

In several embodiments, the housing is positioned on a support structure, and wherein the airfield generator is configured to generate the airfield such that the upwardly directed opening is angled relative to a top surface of the support structure.

In several embodiments, the airfield is generated using air from at least one of the first side of the airfield, the second side of the airfield, or both.

In several embodiments, the airfield generator is configured to reduce particulates sized 0.3 to 1 micron in the air at an efficiency of at least 75%, 80%, 90%, 95%, 97.5%, 99%, or 99.9%. In several embodiments, the airfield generator is configured to reduce particulates sized greater than 1 micron in the air at an efficiency of at least 75%, 80%, 90%, 95%, 97.5%, 99%, or 99.9%. In several embodiments, the particle reduction efficiency is accomplished at a flow rate of 100 cubic feet per minute, 250 cubic feet per minute, 350 cubic feet per minute, 400 cubic feet per minute, 450 cubic feet per minute, 500 cubic feet per minute, 650 cubic feet per minute, 750 cubic feet per minute, 1000 cubic feet per minute, or ranges including and/or spanning the aforementioned values.

In several embodiments, the airfield generator is configured to reduce incidences of infectious disease transfer, and wherein the infectious diseases is a common cold, influenza, and/or COVID.

Several embodiments pertain to a method for reducing incidences of infectious disease transfer. In several embodiments, the method comprises obtaining an airfield generator. In several embodiments, the method comprises activating the airfield generator. In several embodiments, the method comprises causing the motor to generate an air flow from an ambient environment surrounding the airfield generator, through the filter system, and out the outlet of the housing, thereby generating an airfield. In several embodiments, the infectious disease is caused by one or more of a Rhinoviruses, Coronavirus, influenza virus types A, B, C, D, *Streptococcus pneumoniae, Haemophilus influenzae, Moraxella catarrhalis, Staphylococcus aureus*, other streptococci species, anaerobic bacteria, or gram negative bacteria.

Several embodiments pertain to a method for reducing symptoms of allergy. In several embodiments, the method comprises obtaining an airfield generator. In several embodiments, the method comprises activating the airfield generator. In several embodiments, the method comprises causing the motor to generate an air flow from an ambient environment surrounding the airfield generator, through the filter system, and out the outlet of the housing, thereby generating an airfield. In several embodiments, the allergy is a seasonal allergy or a food allergy.

Several embodiments pertain to a method for manufacturing an airfield generator. In several embodiments, the method comprises obtaining a housing. In several embodiments, the method comprises obtaining a filter system. In several embodiments, the method comprises obtaining a motor. In several embodiments, the method comprises assembling the housing with the motor. In several embodiments, the method comprises engaging the filter system with the housing. In several embodiments, the method comprises obtaining inserting the plurality of filters into the airfield generator.

Neither the preceding Summary nor the following Detailed Description purports to limit or define the scope of protection. The scope of protection is defined by the claims.

BRIEF DESCRIPTION OF THE DRAWINGS

The following drawings and the associated descriptions are provided to illustrate embodiments of the disclosure and do not limit the scope of the claims. Throughout the drawings, reference numbers are re-used to indicate correspondence between referenced elements.

FIGS. 4A-4E, 5A-5B, 6A-6C, 7, 8A-8D, and 9A-9J depict subsystems of airfield systems in accordance with aspects of this disclosure.

DETAILED DESCRIPTION OF CERTAIN EMBODIMENTS

The disclosure describes various devices, systems, and methods for airfield systems and, in particular, airfield systems to generate separate zones of space using a filtered airfield. For example, the systems may filter an airfield using minimum efficiency reporting value (MERV) filters.

The disclosure will now be described with reference to the accompanying figures, wherein like numerals refer to like elements throughout. The following description is merely illustrative in nature and is in no way intended to limit the disclosure, its application, or uses. It should be understood that steps within a method may be executed in different order without altering the principles of the disclosure. Furthermore, embodiments disclosed herein can include several novel features, no single one of which is solely responsible for its desirable attributes or which is essential to practicing the systems, devices, and methods disclosed herein.

Generally, airfield generators of the disclosure may produce an airfield traveling at a sufficient speed (e.g., approximately 650 feet per minute and/or as disclosed elsewhere herein) across a set distance such that the airfield generator is configured to effectively increase a social distance between the two interacting people (e.g., people who are conversing, laughing, etc.) when the generator is placed in between the individuals. For example, the airfield generator may be configured to redirect any aerosols present in a first individual's breath (e.g., during talking, sneezing, coughing) such that the aerosols are directed away from another individual. For instance, the breath aerosol may be raised into a HVAC intake zone, rather than in the face of other people. In some instances, the airfield can include a volume of air that has been filtered through an optional filter set up, which can be utilized in multiple configurations to address different use cases. Generally, the airfield generators of the disclosure may also assist in increase air changes per hour, ACH change over, to decrease transmission of unfiltered air patriciates, e.g., due to close proximity transmission.

In several embodiments, the social distance between individuals separated by the airfield generator (relative to those not separated by the airfield generator) is increased by a distance of equal to or at least about: 5 feet, 10 feet, 15 feet, 20 feet, or ranges including and/or spanning the aforementioned values. In several embodiments, the equivalent social distance is increased by a factor of equal to or at least about: 2 times (e.g., 2×), 3×, 4×, 5×, 10×, 15×, or 20×, or ranges including and/or spanning the aforementioned values.

A. Overview of Airfield Systems

Figure 1A:
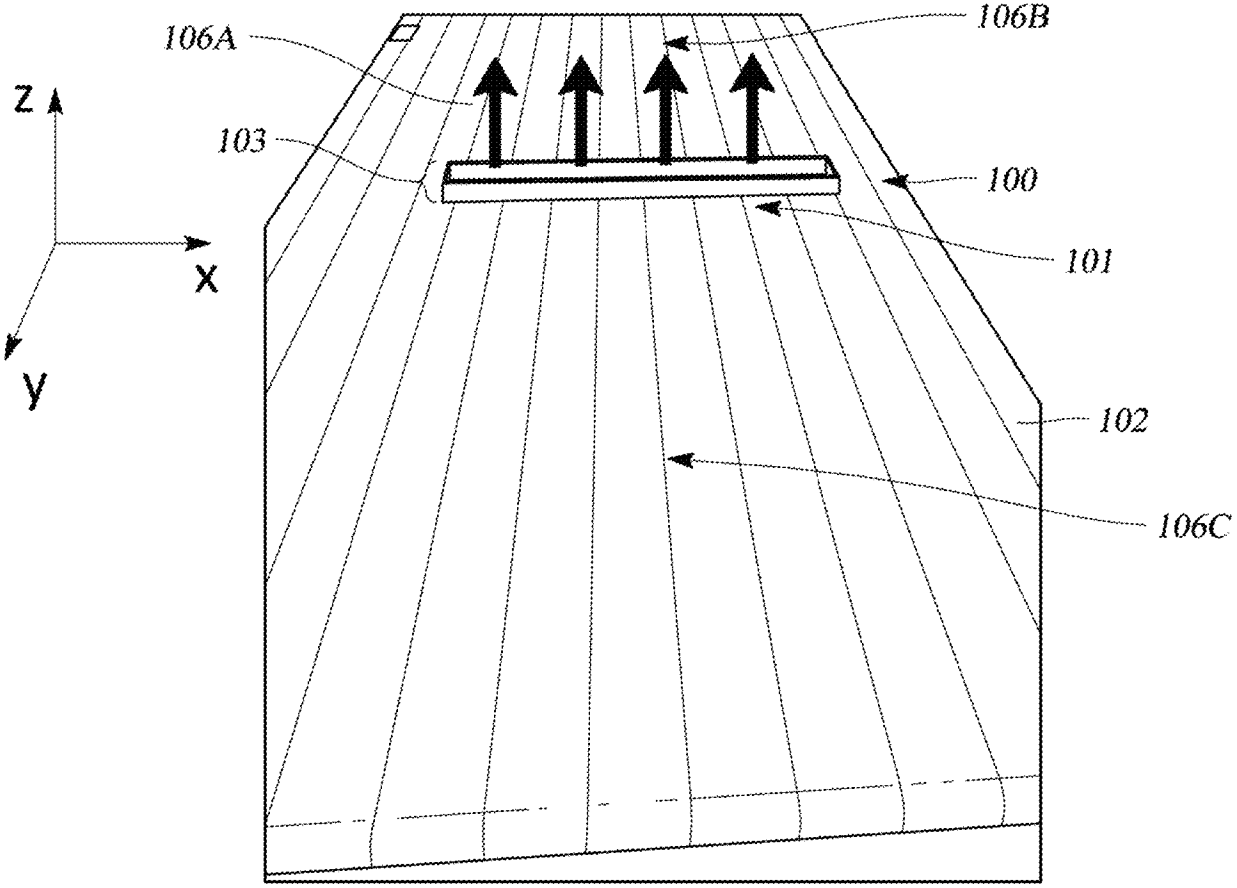
FIGS. 1A-1H illustrate an exemplary airfield system in accordance with aspects of this disclosure.

FIGS. 1A-1G illustrate an exemplary airfield system 100 in accordance with aspects of this disclosure. FIGS. 1A-1G depict different views of the airfield system 100. As depicted in FIG. 1A, airfield system 100 includes an airfield generator 101 and a structure 102. The airfield generator 101 may generate an airfield 106A from outlet 104, as discussed below. For instance, airfield generator 101 may filter environmental air and output filtered air to generate the airfield 106A.

The airfield generator 101 may be positioned so that airfield 106A may separate distinct zones of space 106B and 106C, so that transmission of unfiltered air (and particulates therein) between the distinct zones of space 106B and 106C is reduced. For instance, the distinct zones of space 106B and 106C may be adjacent to the airfield generator 101 and separated by the airfield 106A for at least a defined length (e.g., at least a length of the outlet 104 of the airfield generator 101). The airfield 106A may pull ambient air in the distinct zones of space 106B and 106C into the airfield 106A increasing airflow and circulation in the distinct zones of space 106B and 106C creating an air dam.

As depicted in FIG. 1A, the airfield 106A may be generally directed in the z direction and extend along the x direction, to thereby separate the distinct zones 106B and 106C, for at least a portion along the x direction, in respective y directions. As used herein, the z direction may be a vertical direction (e.g., in a field of gravity), and the x direction and y direction may be lateral directions (referred to as front and back direction for the y direction, and left and right direction for the x direction). In some instances, the z direction may refer to a height of the airfield being generated at least partially in a direction of air flow, the x direction may refer to a length of the airfield being generated (e.g., along a major axis of the airfield), and the y direction may refer to a width or depth of the airfield (e.g., along a minor axis of the airfield).

Various embodiments of the airfield generator 101 as described herein may provide the benefits of producing a high-volume amount of compact air through the airfield 106A with the use of a generator 101 that is compact in size. The airfield 106A can be generated generally along the z direction in an upward direction.

The outlet 104 of the airfield generator 101 may be various shapes to output the airfield 106A. FIGS. 1A-1G illustrate an outlet 104 with a generally elongated rectangular shape. However, it will be understood that the outlet 104 may be any size or shape suitable to generate an airfield. For example, the outlet 104 may comprise a generally curved shape. In some instances, the curve may be configured such that at least one of the individuals in one of the distinct zones 106B, 106C is located at a focal point of the curve. The outlet 104 may have a width 103 in they direction. In some embodiments, the outlet 104 may have a constant width 103 across the outlet 104 in the x direction. In other embodiments, the width 103 may be different across the outlet 104 in the x direction. For example, the width 103 may be larger at the middle of the outlet 104 than the width 103 at the ends of the outlet 104 so the air speed is constant across the outlet 104 in the x direction.

In some embodiments, the outlet 104 may be a nozzle with a continuous opening. However, the outlet 104 may instead have a non-continuous opening, such as with a grate or other structure to inhibit or prevent foreign objects to enter the outlet 104, while still allowing a continuous airfield 106A to be output therefrom.

Figure 2A:
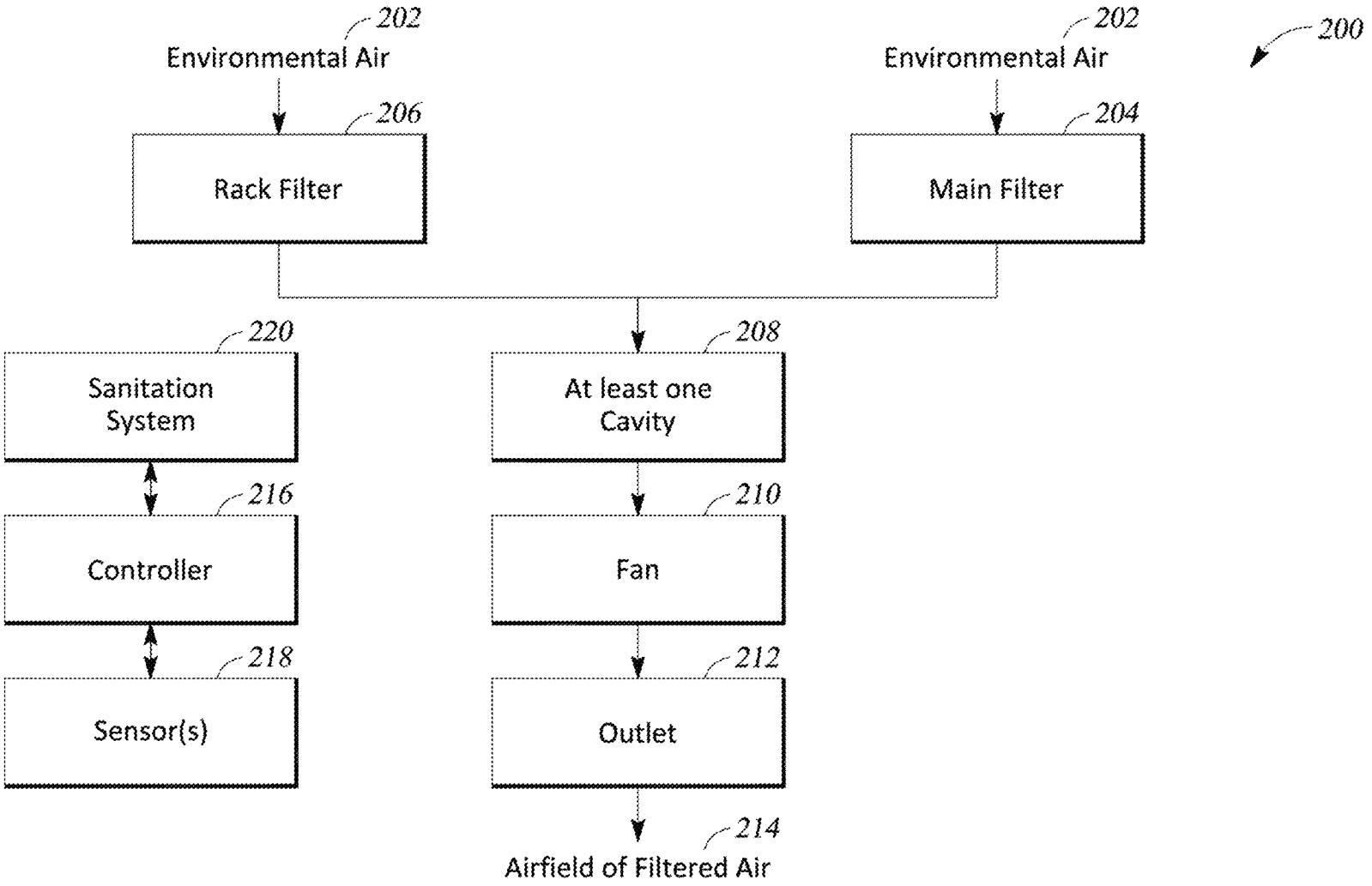
FIG. 2A schematically illustrates a block diagram of an airfield generator in accordance with aspects of this disclosure.

The outlet 104 may be adjustable to change one or more features of the airfield 106A (e.g., a direction, angle relative to the surface of the structure 102, size, air speed, volume of air generated, etc.). For instance, the outlet 104 may be adjustable to change an angle of air flow relative to a z axis, such as from forward to backward or backward to forward within a defined range of angles. For instance, the range may be ±45° relative to the z axis. The range may be ±15°, ±25°, ±35°, ±45°, ±50°, ±60°, ±70°, ±80°, or ranges including and/or spanning the aforementioned values. As an example, the outlet 104 may be hinged to thereby adjust the angle from the z direction at which the airfield 106A is projected into space, thereby adjusting the distinct zones of space 106B and 106C. In some embodiments, the outlet 104 may be adjustable manually or electronically via a controller 216 (described below with reference to FIG. 2A). In some embodiments, the outlet 104 may automatically move from forward to backward and backward to forward within at least a portion of the defined range of angles at a predetermined angular velocity and/or at predetermined intervals. In the case of a structure 102 with a surface (such as a table), the outlet 104 may protrude through the surface to a fixed height in the z direction from the surface. For instance, the protrusion of the outlet 104 may enable the outlet 104 to be adjusted through the defined range of angle without interfering with the surface.

Figure 11:
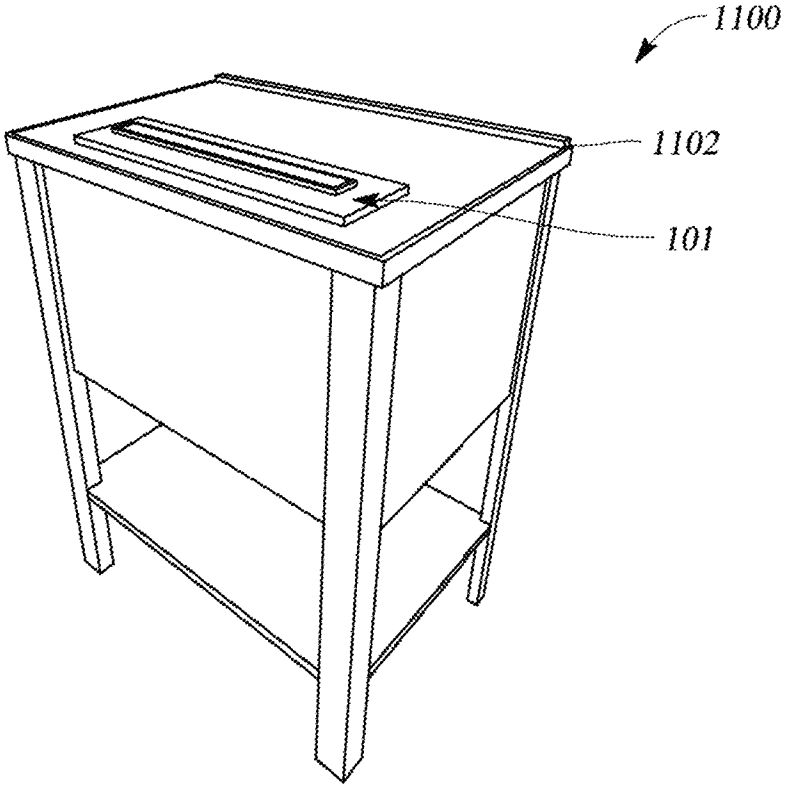
FIG. 11 illustrates an exemplary airfield system in accordance with aspects of this disclosure.

Generally, the structure 102 may include various different forms of supports. As depicted in FIGS. 1A-1G, the structure 102 may be an item of furniture, such as a table. The structure 102 (e.g., table) may have a surface. The structure 102 may separate two or more groups of people in respective zones of space. However, one of skill in the art would recognize that the structure could alternatively be, for example, a counter (e.g., at a checkout/check-in of a business, at a bar, etc.), a mobile stand to support the airfield generator 101, a wall fixture, a barrier (e.g., between office desks, cubicles, etc.), a portion of an HVAC system, a ceiling, a drop ceiling, a portion of a vehicle, etc. Therefore, generally, the structure 102 may be a physical object that may fix and hold the airfield generator 101 in place, so that the airfield generator 101 may generate the airfield 106A and the distinct zones of space 106B and 106C. As an additional example, FIG. 11 depicts an alternative airfield system 1100. Airfield system 1100 may include the airfield generator 101 with a different structure 1102. The different structure 1102 may be an article of furniture, such as a podium (as depicted), or otherwise. In various embodiments, the structure 102 comprises, and/or the airfield generator 101 is comprised, in a desk, podium, counter, table, wall or pony wall, ceiling, floor, etc. In some embodiments, the structure 102 comprises, and/or the airfield generator 101 is comprised, in a vehicle, such as a car or airplane (e.g., to generate an airfield barrier between adjacent occupants or passengers).

While only one airfield generator 101, one airfield 106A, and two distinct zones of space 106B and 106C are depicted in FIG. 1A, one of skill in the art would recognize that multiple (e.g., two or more) airfield generators 101 may be arranged to generate multiple (e.g., two or more) airfields 106A to generate a plurality of zones of space 106B and 106C. Generally, the arrangement of airfield generators 101 (and their respective airfields 106A) may define boundaries of the plurality of zones of space 106B and 106C. For instance, airfield generators 101 (and their respective airfields 106A) may be orthogonal to each other, or arranged at an acute or obtuse angle with respect to each other and spaced a part to define the boundaries of the plurality of zones of space 106B and 106C.

Figure 1C:
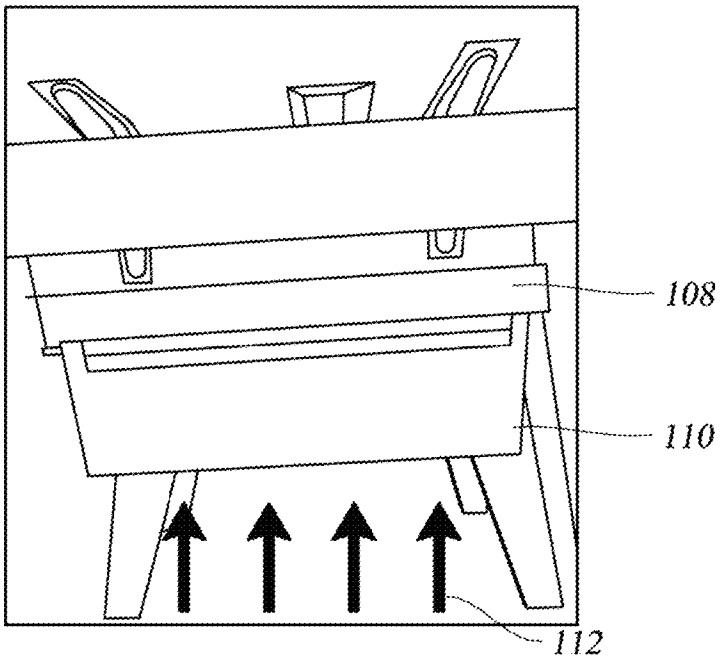
Figure 1B:
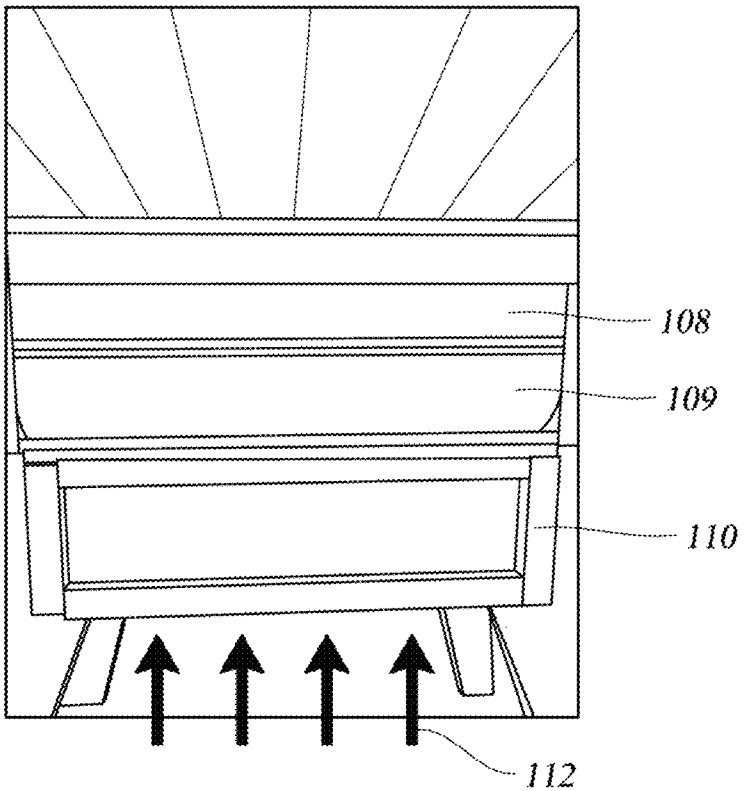
Figure 1E:
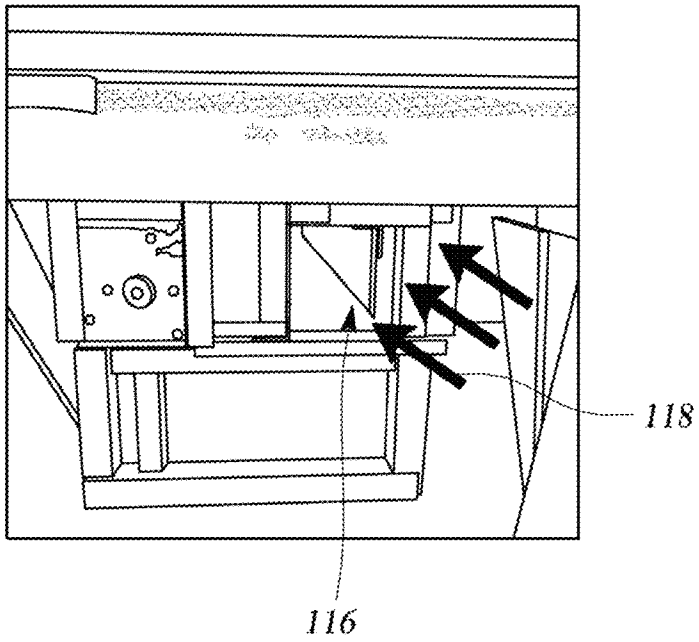
Figure 1D:
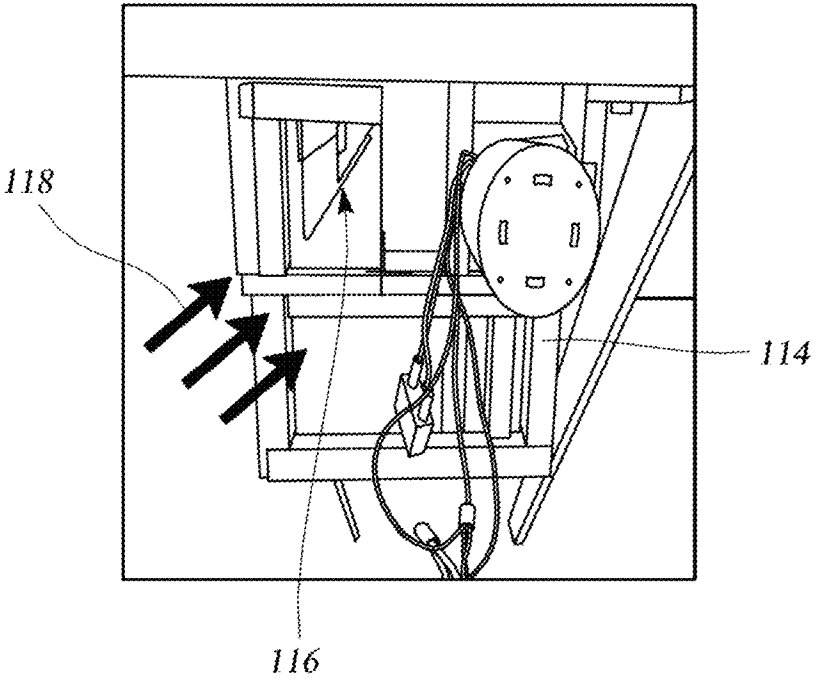
Figure 1G:
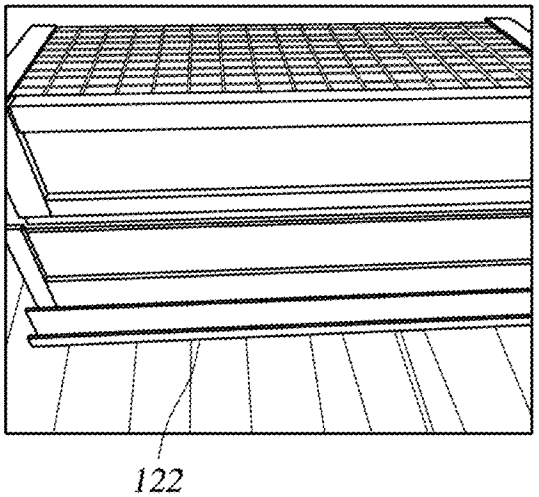
Figure 1F:
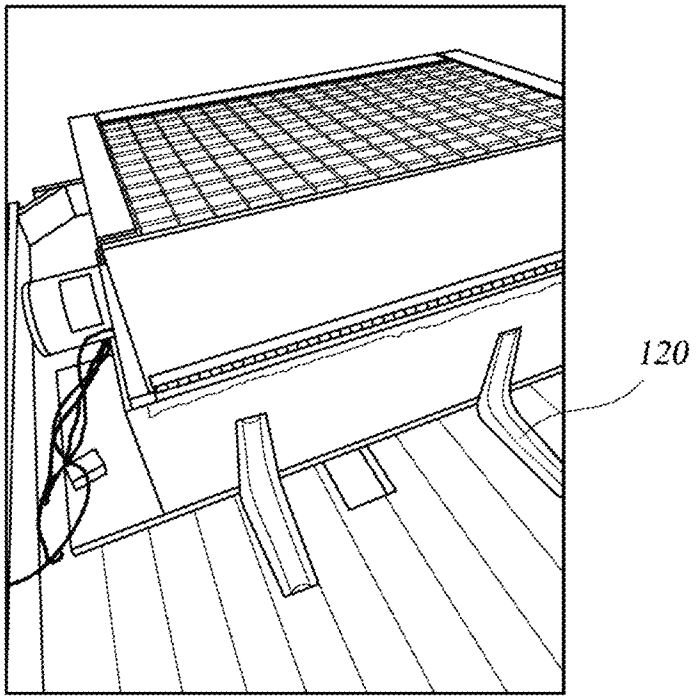

FIGS. 1B-1C depict features of various embodiments of the airfield generator 101 from below the surface of the structure 102, from front and back views, respectively, of the airfield generator 101. One of skill in the art would recognize that, when the structure 102 does not include a surface, the airfield generator 101 may have the same components, but the outlet 104 may be changed (e.g., shortened) as the protrusion through the surface may not be necessary. In particular, FIGS. 1B-1C depict a base 108, a fan 109 (also called a blower), and a main filter housing 110 of airfield generator 101. The fan 109 can comprise, for example, a centrifugal fan, axial fan, or otherwise. FIGS. 1D-1E depict features of various embodiments of the airfield generator 101 from below the surface of the structure 102, from a left and right views of the airfield generator 101. In particular, FIGS. 1B-1C depict a motor 114 and bypass inlets 116 of airfield generator 101. FIGS. 1F-1G depict features of various embodiments of the airfield generator 101 from below the surface of the structure 102. In particular, FIGS. 1F-1H depict various attachment systems 120, 122 and 124 of airfield generator 101.

The base 108 may have an interior volume to receive filtered air from a main filter (e.g., in the main filter housing 110) and a rack filter 802 (e.g., via the bypass inlets 116 as illustrated in FIGS. 8A-8D) into at least one cavity (e.g., as illustrated in FIGS. 4A-4E) to pass the filtered air to the centrifugal fan 109. The base 108 may also be configured to removably secure the centrifugal fan 109 and motor 114 to create a sealed interface therebetween during operation (e.g., from vibrations and attenuate noise). The base 108 may provide for a sealed interface to enclose and protect one or more components (e.g., the centrifugal fan 109 and the motor 114) from the external environment. For example, the base 108, when closed, may provide for an internal cavity that is water-proof (or at least water-resistant) to inhibit unintended fluid (e.g., liquids) from entering into the internal cavity of the base 108.

As illustrated in FIGS. 1F-1G, the attachment systems 120 and 122 may secure the base 108 to the structure 102. For instance, attachment systems 120 and 122 may be a bracket, which may be discontinuous (such as attachment system 120) or continuous along a length of the base 108 (such as attachment system 122). The attachment systems 120 and 122 may use, e.g., fasteners to attach the base 108 to the structure 102, but one of skill in the art would recognize that other approaches may be taken (e.g., adhesive, etc.).

Figure 1H:
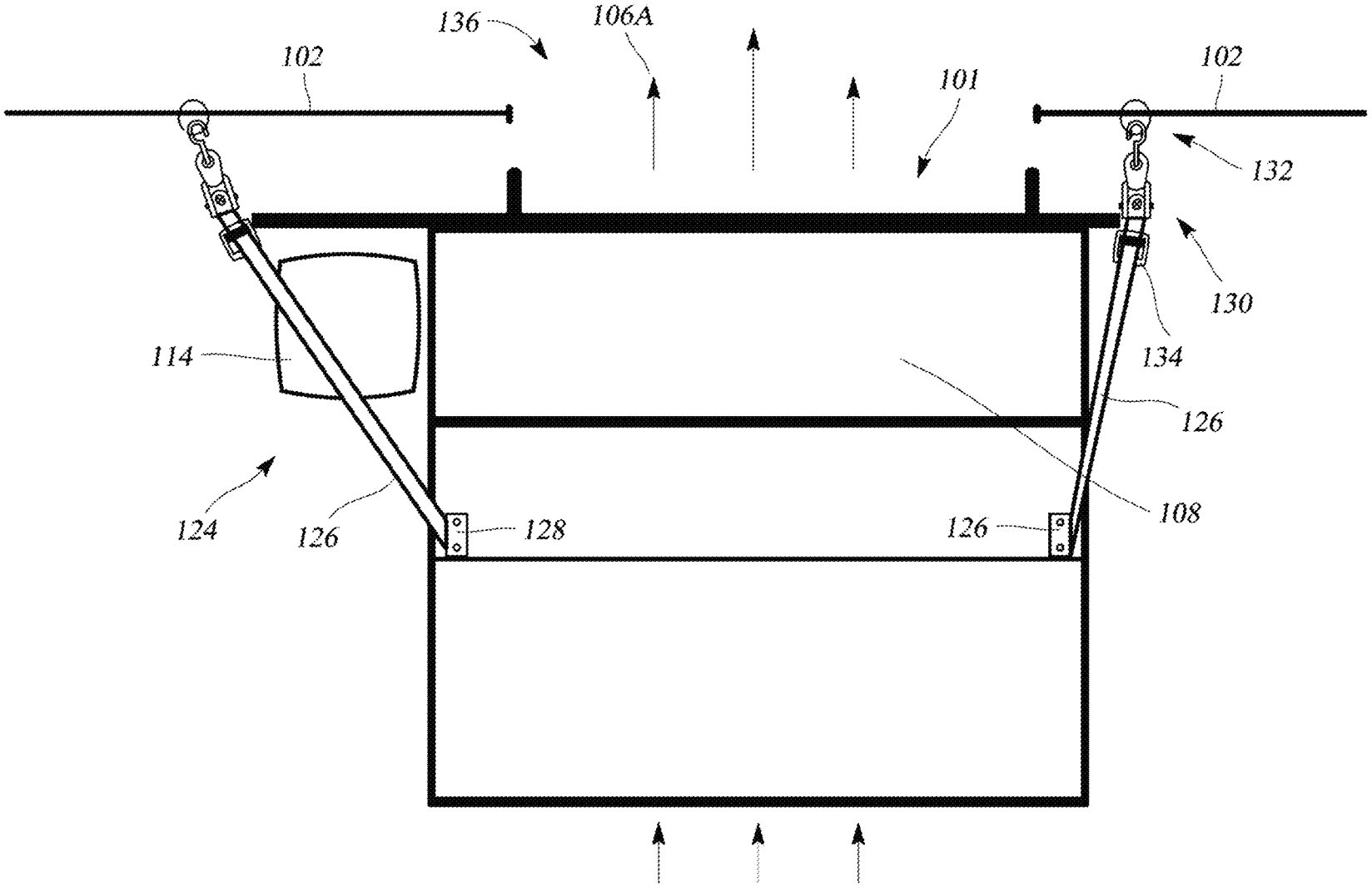

In some embodiments, as shown in FIG. 1H, the attachment system 124 may secure the base 108 to the structure 102 via vibration dampeners 126. The vibrations dampeners 126 may be straps, nylon straps, rubber, springs, wires, or any other vibration dampening connection. In some embodiments, the vibration dampeners 126 may be one or more pieces of rubber coupled to the base 108 and the structure 108. In the embodiments, where the vibration dampeners 126 are straps or nylon straps, the vibration dampeners 126 may be secured to the base 108 via one or more connectors 128. The connectors may be a metal plate screwed into the base 108, or any other fastener for connecting the straps to the base 108.

The vibration dampeners 126 may secure the base 108 to the structure 102 such that the base 108 is free floating. The vibration dampeners 126 may be coupled to the structure by connection system 130. The connection system 130 may include a connecting portion 132 and an adjustment portion 134. The connecting portion 132 may rotatably or movably couple the vibration dampeners 126 to the structure 102 such that when the base 108 moves or vibrates, the vibration dampeners 126 can move or vibrate relative to the structure 102 without transferring any movement or vibration to the structure 102. In this way, when the motor 114 is powered and generating airfield 106A, vibration or movement of the base 108 created by the motor 114 and the centrifugal fan 109 does not transfer, or is reduced from transferring, from the base 108 to the structure 102.

The adjustment portion 134 may allow a user to change a length of the vibration dampeners 126. The user may secure the base 108 to the structure 102 as shown in FIG. 1H so the outlet 104 is below the structure 102, or the user may use the 134 to shorten a length of the vibration dampeners 126 so the outlet 104 may extend through an opening 136 above the structure 102.

In some embodiments, the opening 136 in the structure 102 may be larger than the outlet 104 so that if the outlet 104 is above the structure 102, when the base 108 vibrates or moves, the outlet 104 may vibrate or move without contacting the structure 102.

In some embodiments, the structure 102 may be a ceiling or a drop ceiling, and the base 108 may be secured to a secondary structure so the base 108 can be hung (e.g., upside down) above the structure 102. The secondary structure may be a surface above a drop ceiling, a portion of an HVAC system or a surface near the portion of the HVAC system, or any other structure above or near the structure 102. The base 108 may be uncoupled to the structure 102 so the movement or vibration of the base 108 will not be transferred to the structure 102. The vibration dampeners 126 may reduce or eliminate caused nose cause by movement or vibration that may be transferred from the base 108 to the secondary structure.

The vibration dampeners 126 may reduce or eliminate vibration or movement of the structure 102 and/or reduce or eliminate sound caused by the vibration or movement of the structure 102.

In the embodiments where the structure 102 or the secondary structure are a portion of an HVAC system or a surface near the portion of the HVAC system, the airfield generator 101 may provide purification to the HVAC system, and the base 108 may be positioned so the airfield 106A is directed into the HVAC system.

Figure 7:
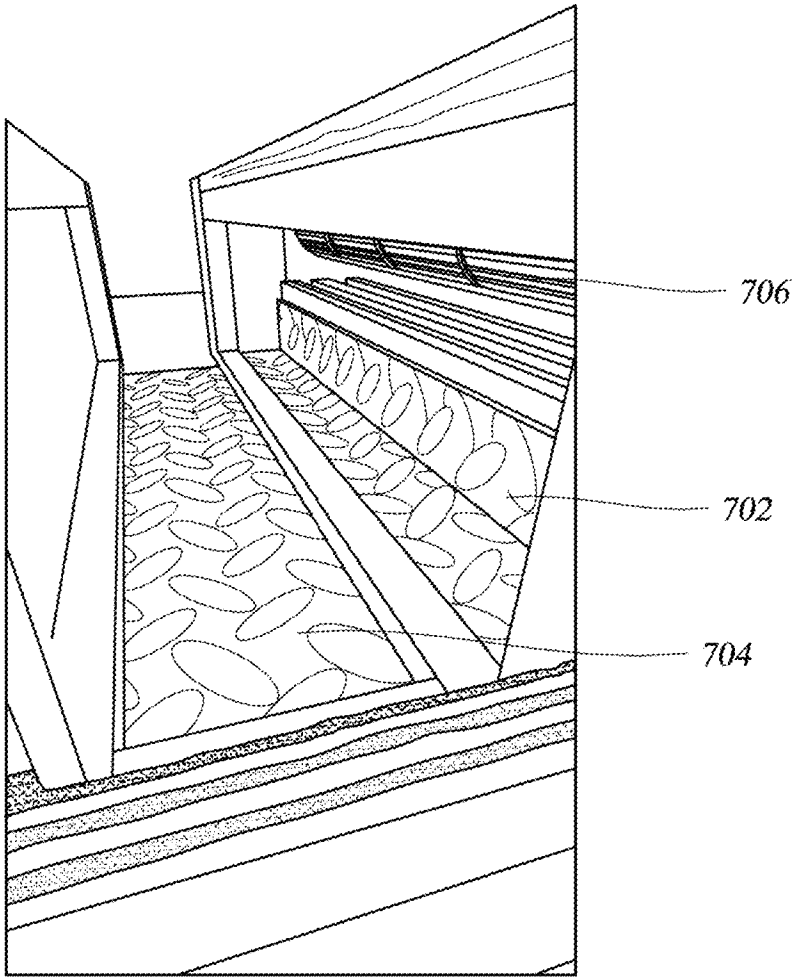
Figure 8B:
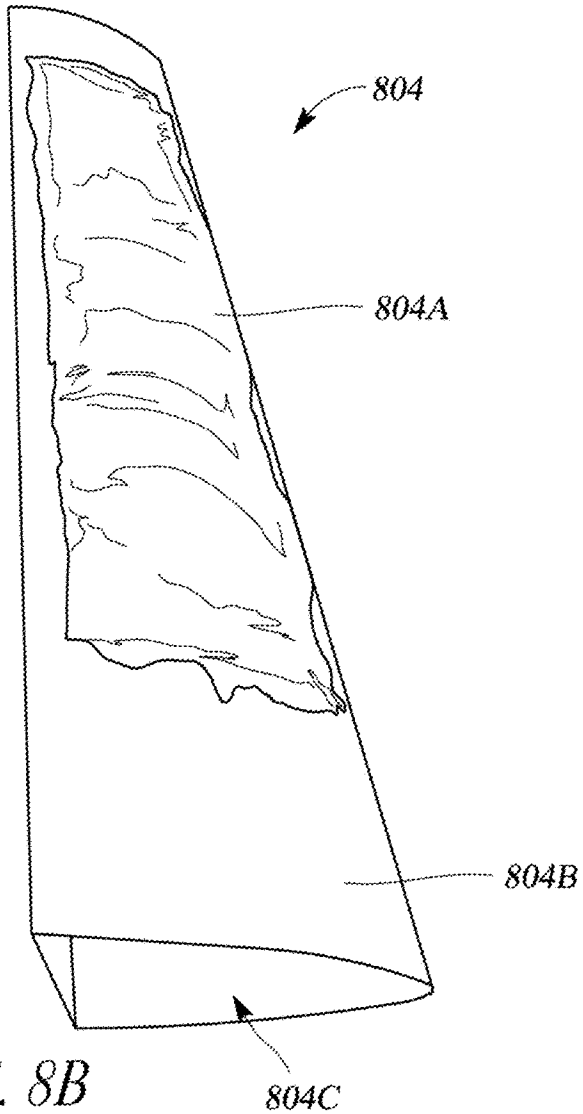
Figure 8A:
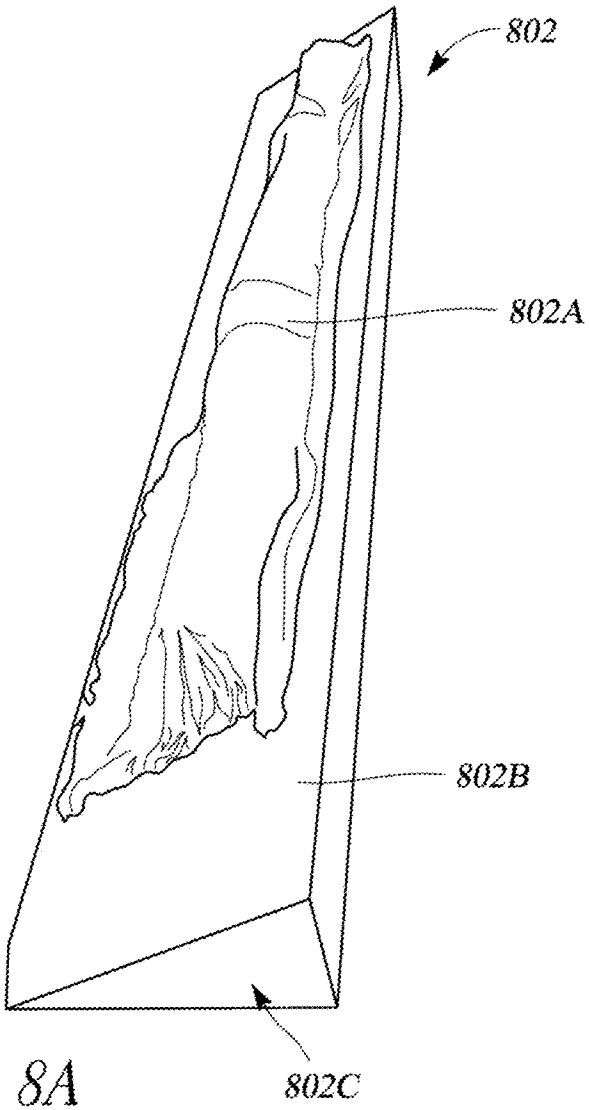
Figure 8D:
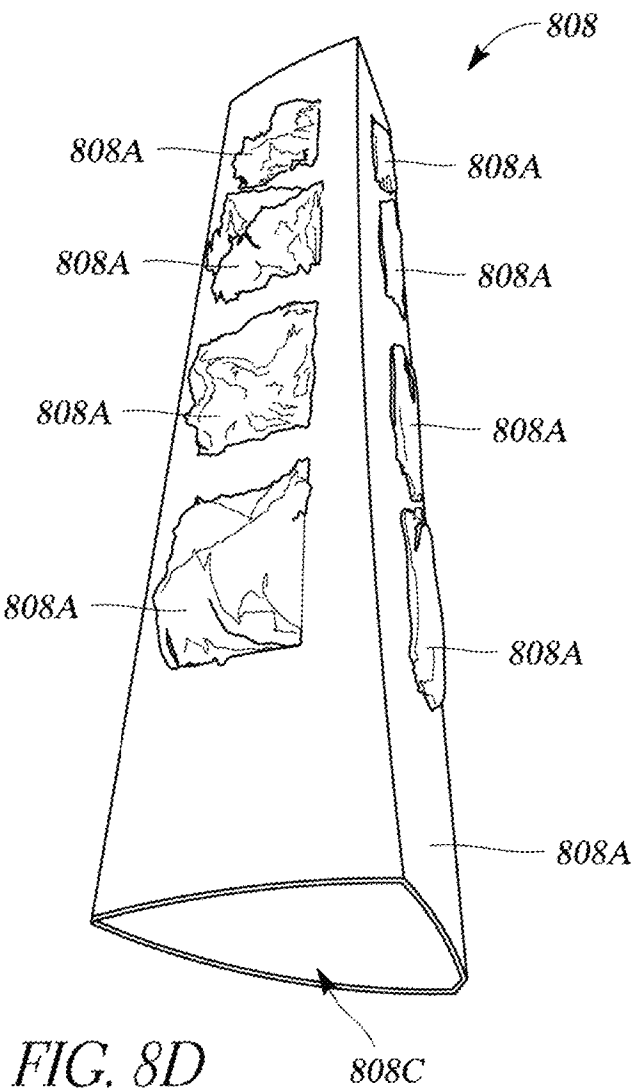
Figure 8C:
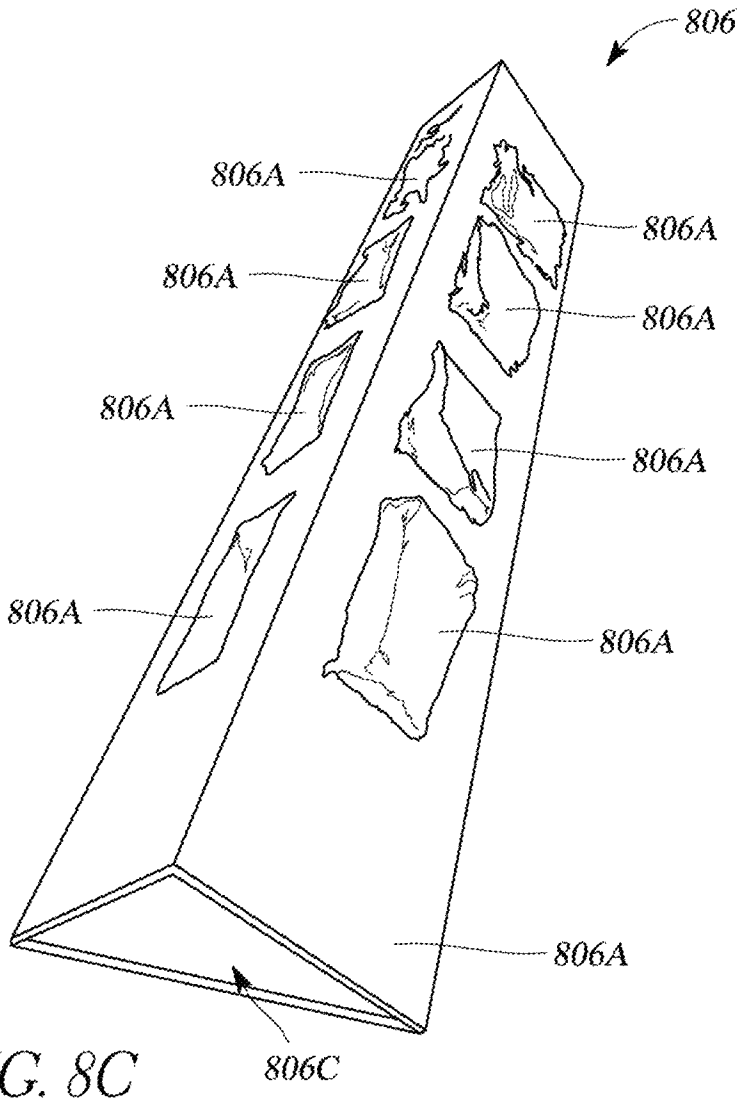
Figure 9A:
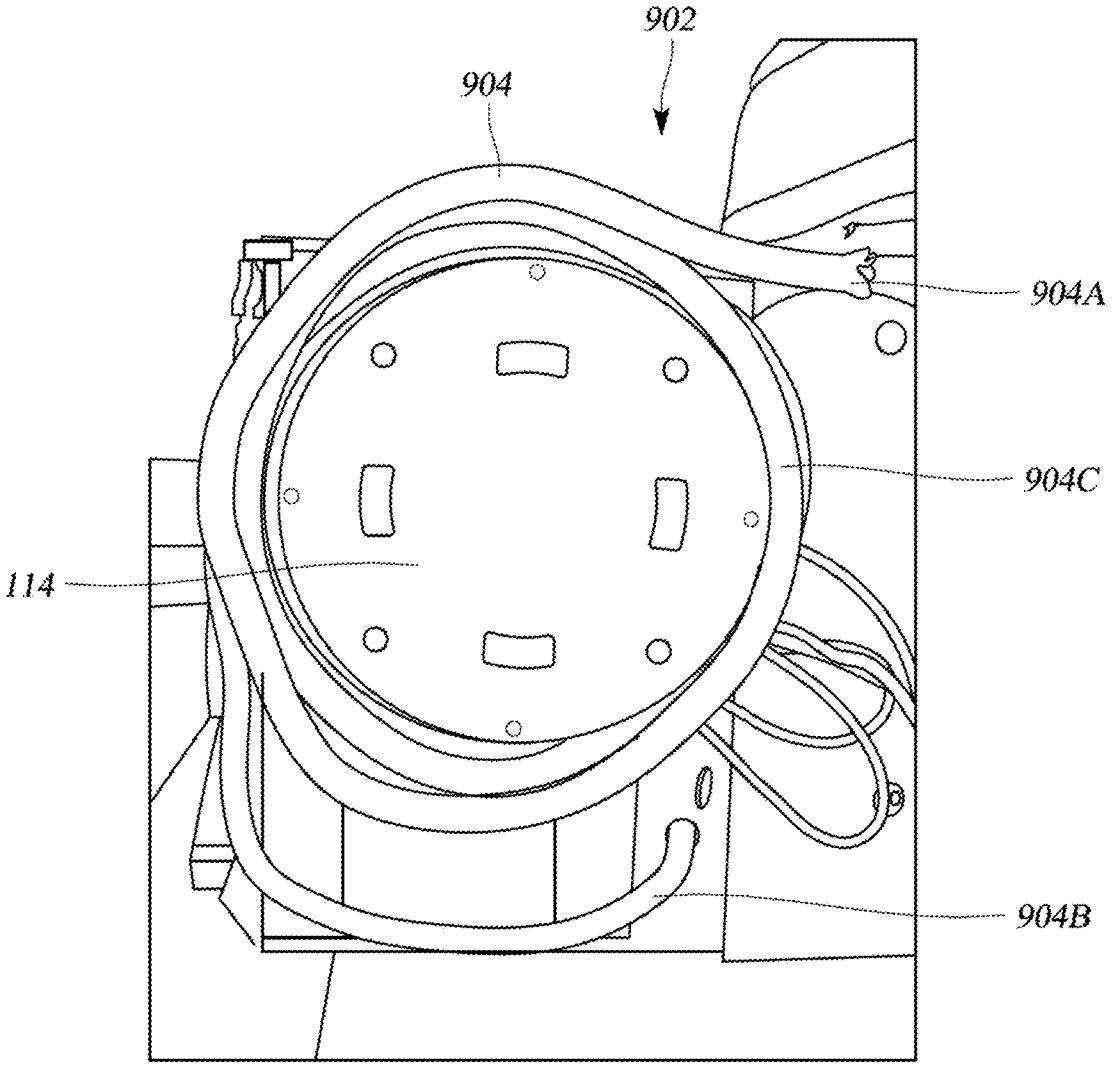
Figure 9B:
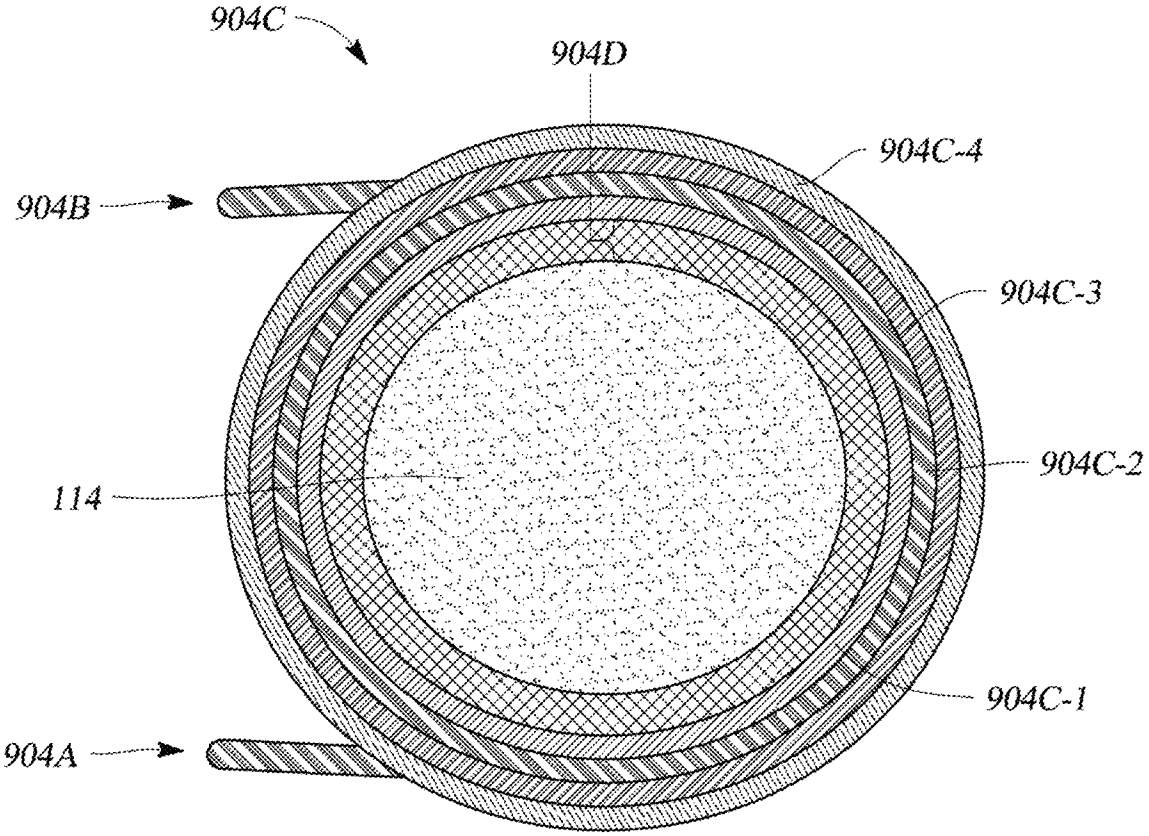
Figure 9C:
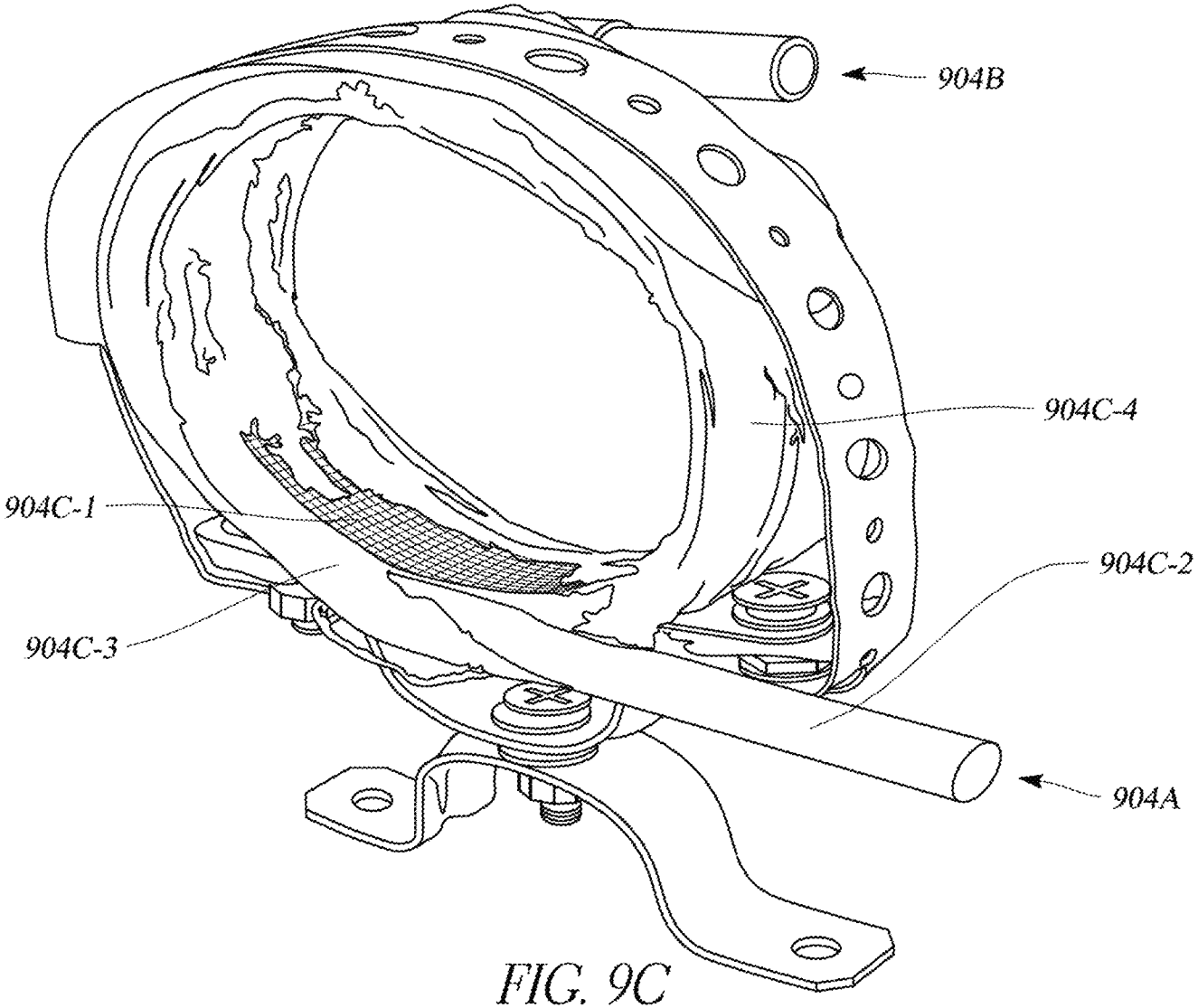
Figure 9D:
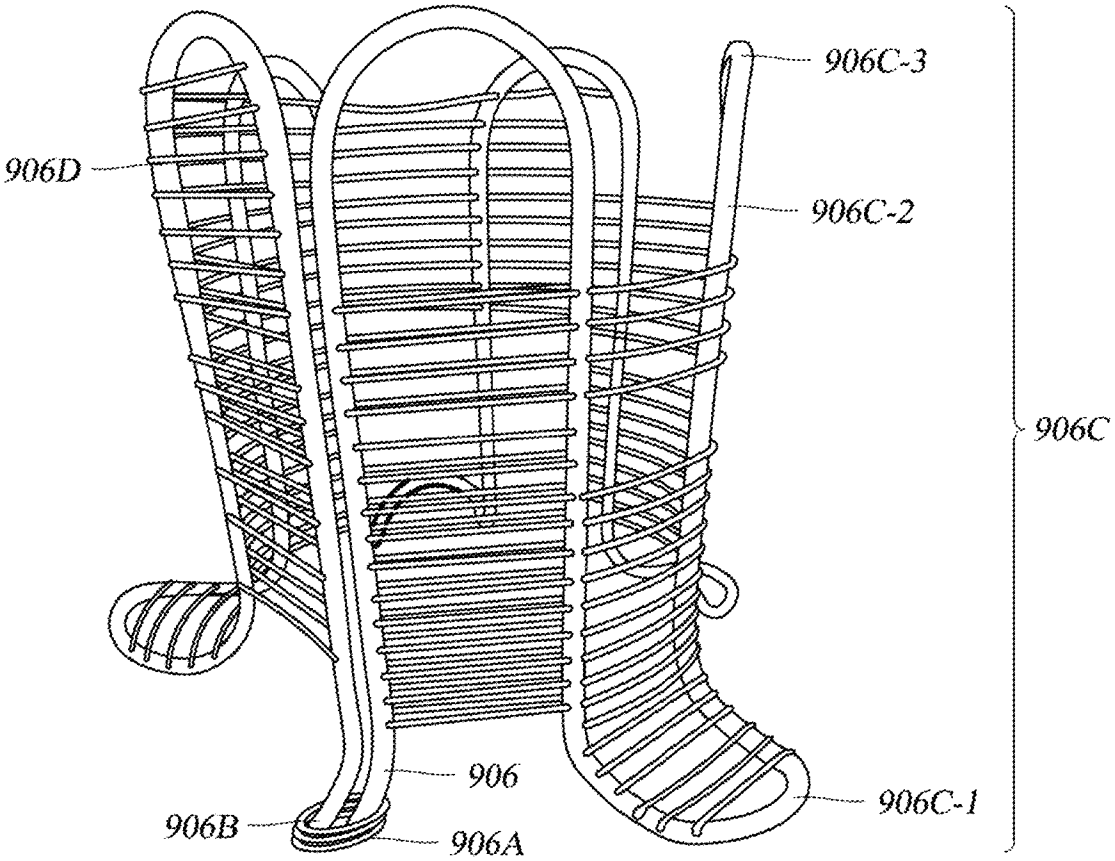
Figure 9E:
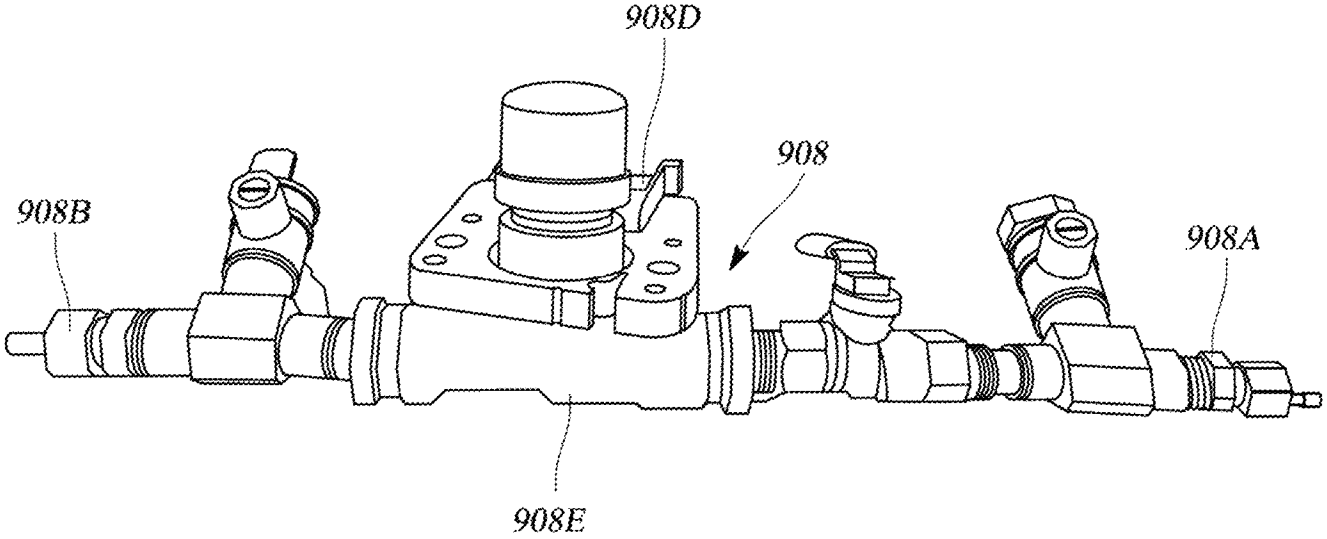
Figure 9G:
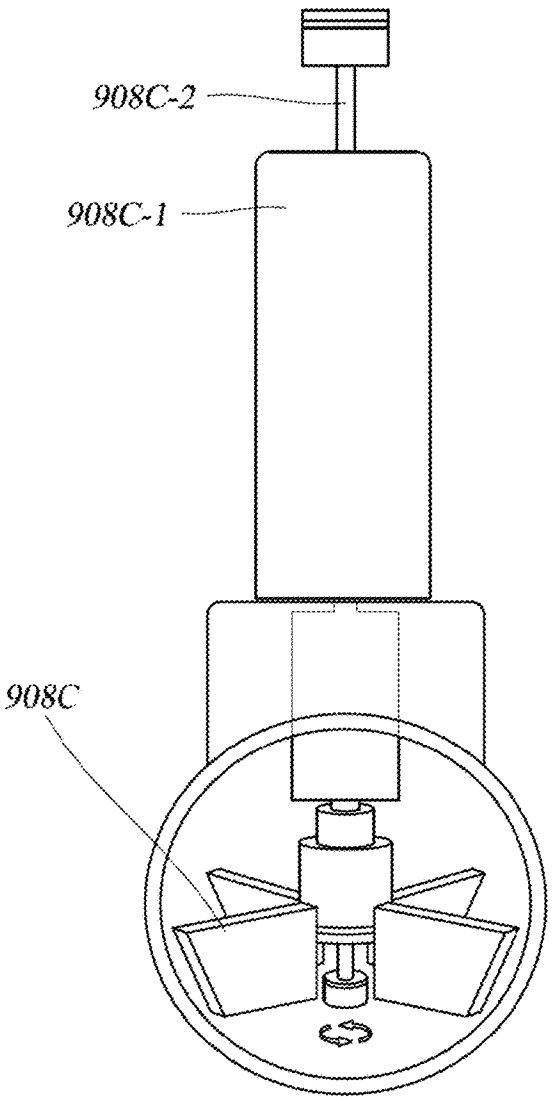
Figure 9F:
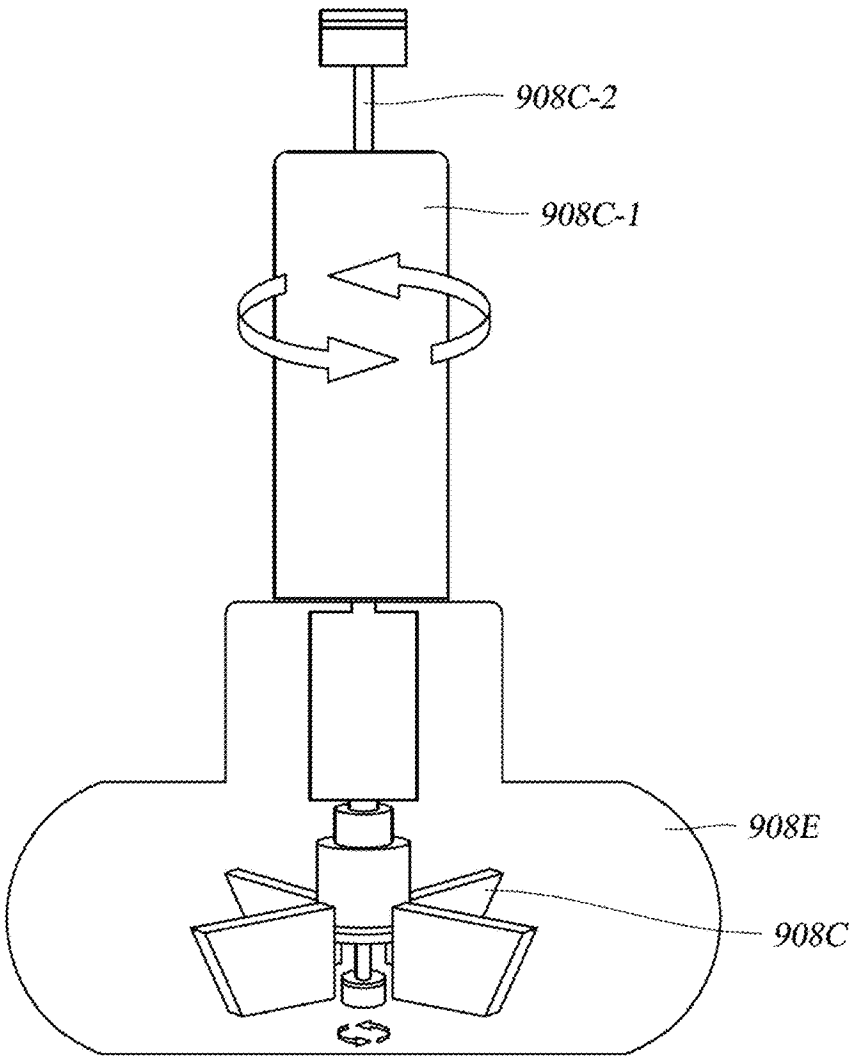
Figure 9H:
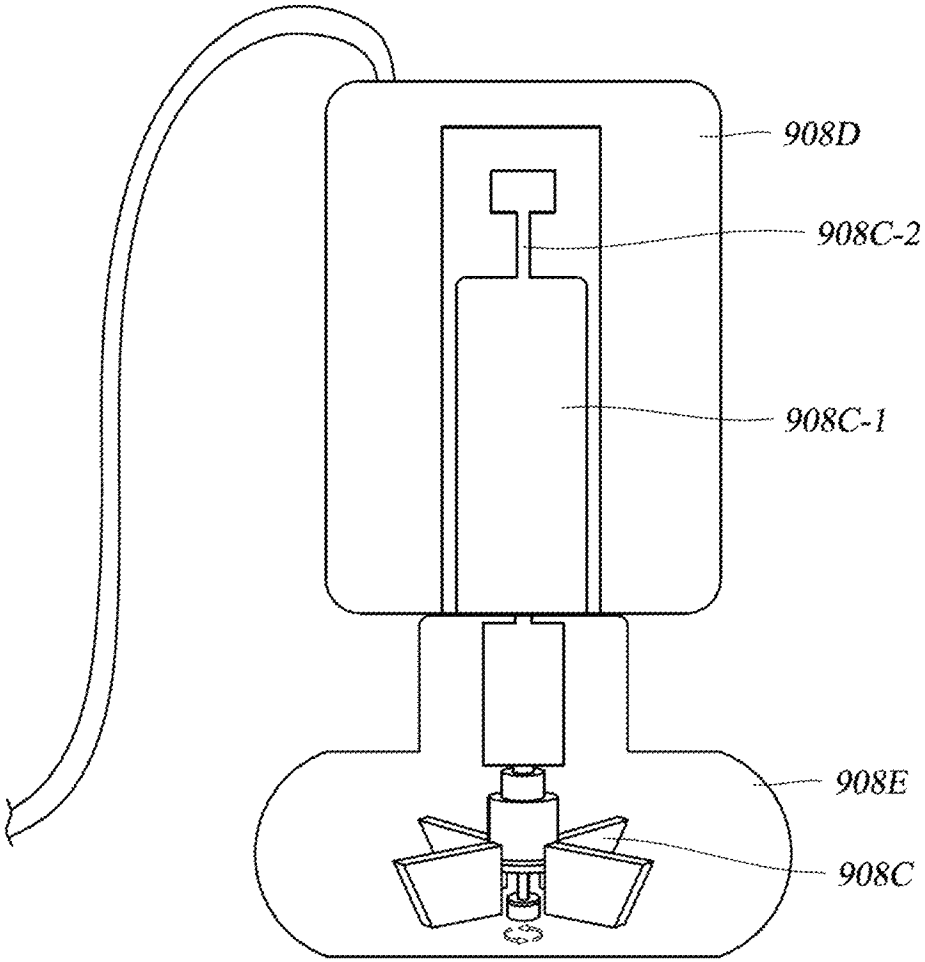
Figure 9J:
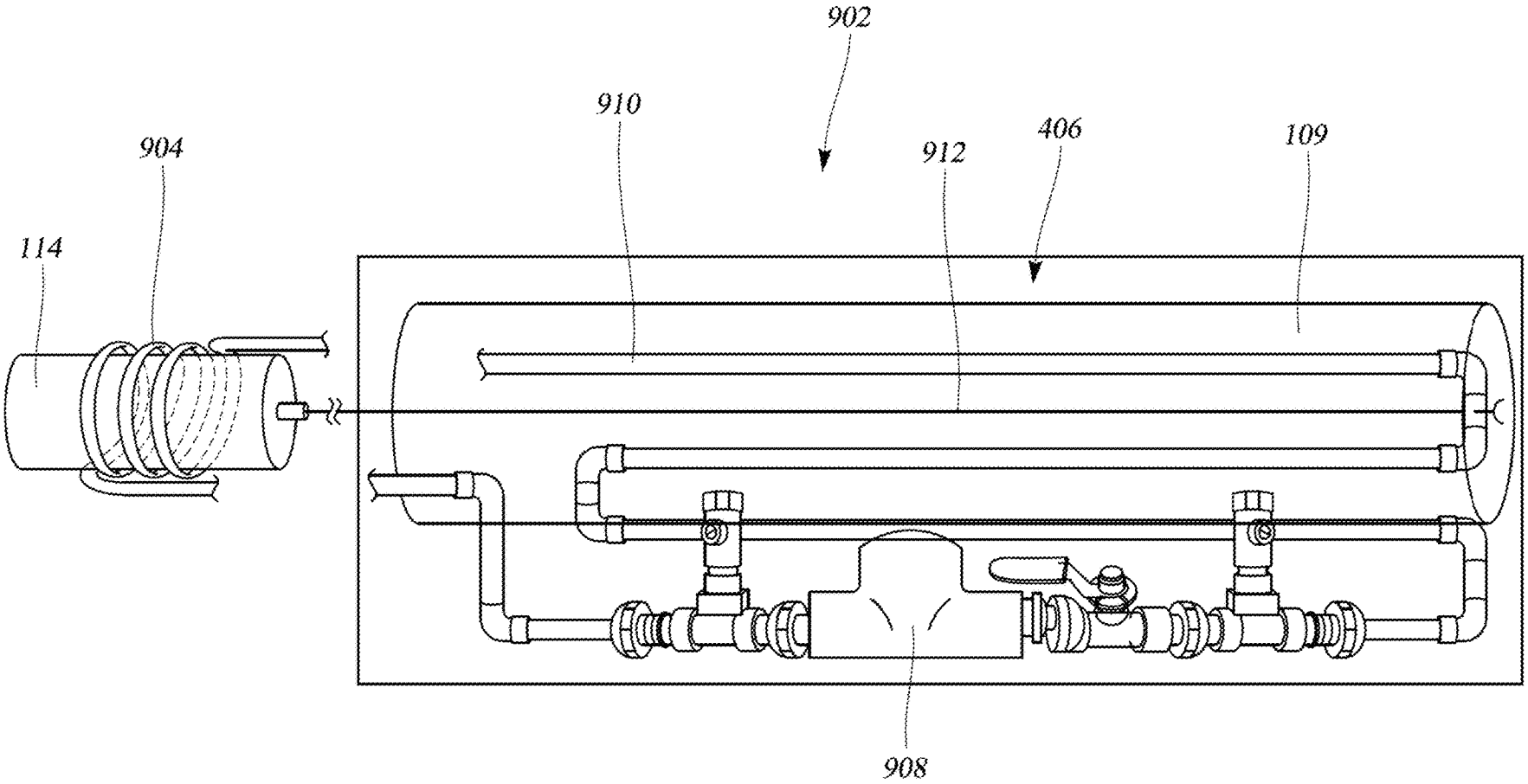

With reference to FIG. 1B, the centrifugal fan 109 may receive filtered air from the at least one cavity, compress the filtered air to increase the airflow speed of the filtered air, output the compressed filtered air to the outlet 104 to thereby generate the airfield 106A. The motor 114 may control operation of the centrifugal fan 109 by rotating impellers 706 (e.g., as illustrated in FIG. 7) of the centrifugal fan 109 at fixed or various speeds via a shaft 912 (e.g., as illustrated in FIG. 9J). For instance, the motor 114 may cause the impellers 706 of the centrifugal fan 109 to rotate at a fixed rotation per minute (RPM). Alternatively, the motor 114 may cause the impellers 706 to rotate at various RPMs, such as from a first RPM to a second RPM to increase airflow speed of the airfield 106A from a first airflow speed to a second airflow speed.

Generally, the centrifugal fan 109 may extend axially along an axis of rotation of the impellers 706, with a first opening in a shroud of the centrifugal fan 109 to receive the filtered air and a second opening in the shroud to output the compressed filtered air to the outlet 104. The first and second openings may be substantially similar in length to each other and to the outlet 104. The centrifugal fan 109 may be positioned along one end of the base 108 to be secured to the base 108 by, e.g., fasteners. For instance, the centrifugal fan 109 may be adjacent to, abut, or overlap an edge of the base 108 on a front or rear of the base 108. The motor 114 may be attached to the centrifugal fan 109.

In some instances, the motor 114 can comprise an inductive or alternating-current (AC) motor. The inductive motor can advantageously increase the durability and/or power of the motor 114 to improve the filtration capability of the airfield system 100. For example, an increased power may permit the motor 114 to force an increased amount of air, relative to alternative motor designs, through higher quality filtration components. The higher quality filter components may include an increased number and/or rating of the filter. In some instances, the motor 114 may be configured to generate an airfield 106A with air passing through at a rate of about 370 cubic feet per minute. The motor 114, in some embodiments, may be configured to generate an airfield 106A with air passing through at a rate of about 275 cubic feet per minute if the air is being filtered through two separate MERV 8 filters. An inductive motor may advantageously provide a steady, reliable movement of air relative to alternative designs that may result in variability of the rate of air flow throughout use.

Figure 4A:
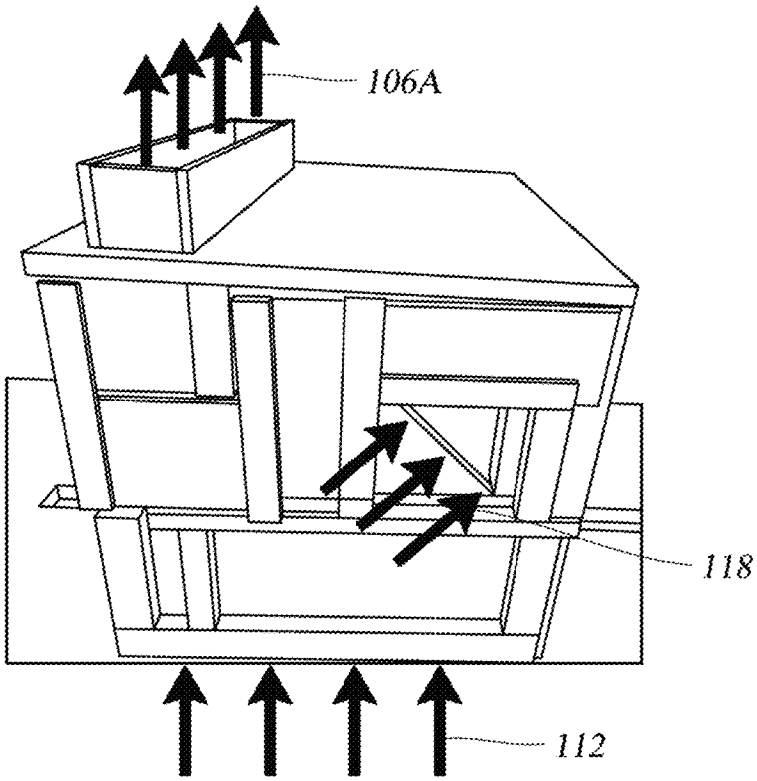
Figure 4B:
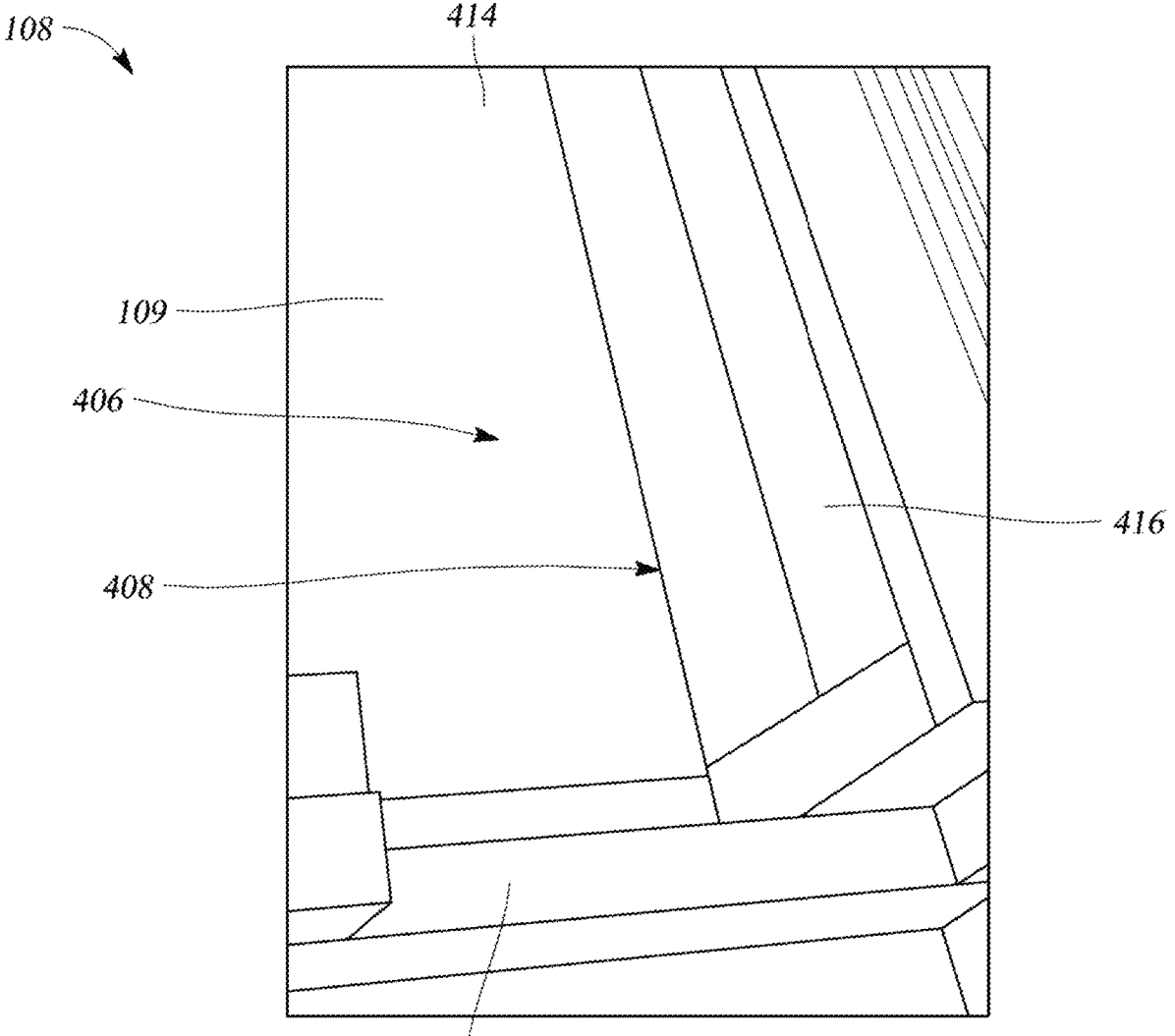
Figure 4C:
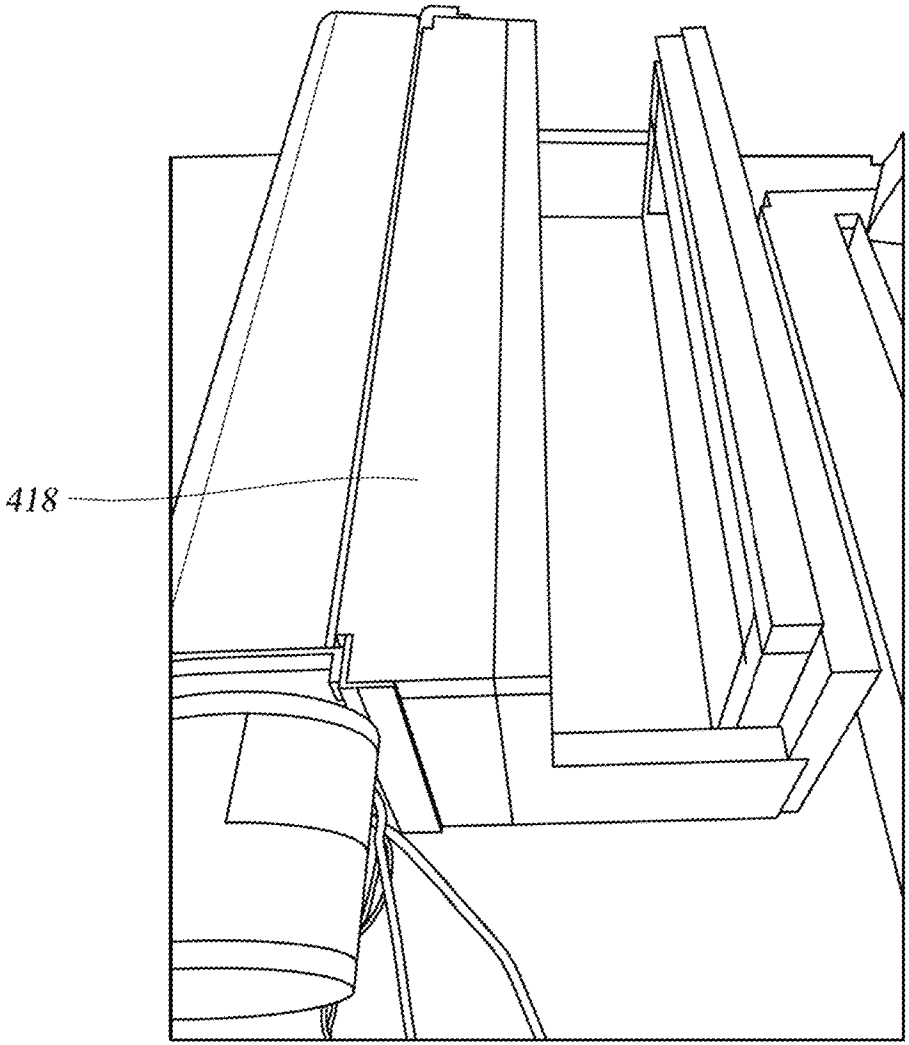
Figure 4D:
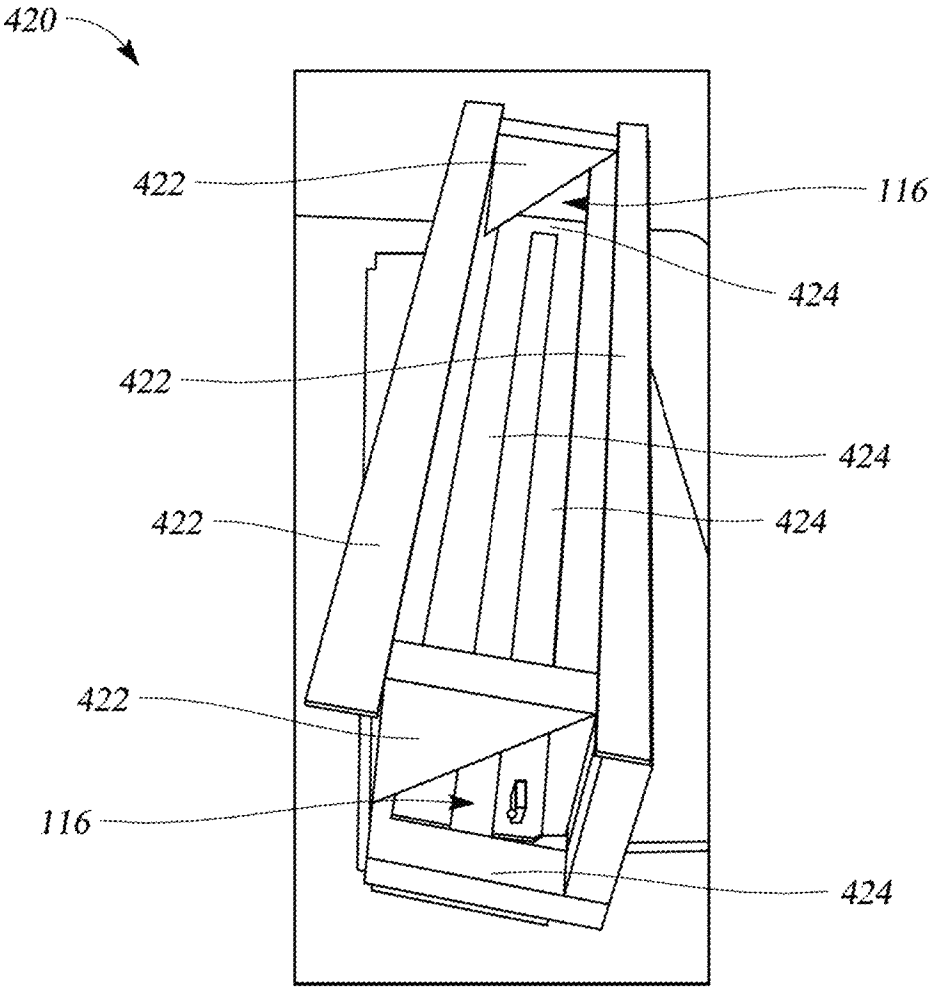
Figure 6A:
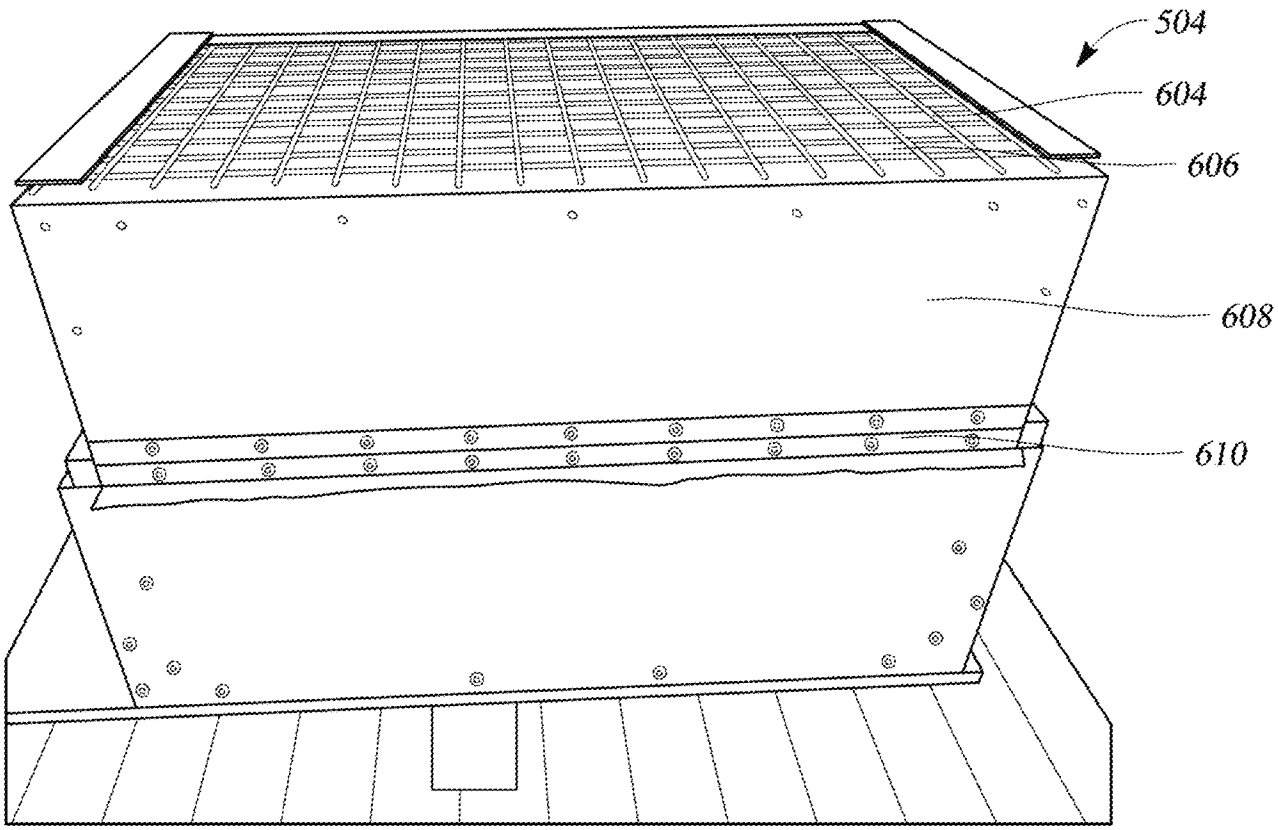
Figure 6B:
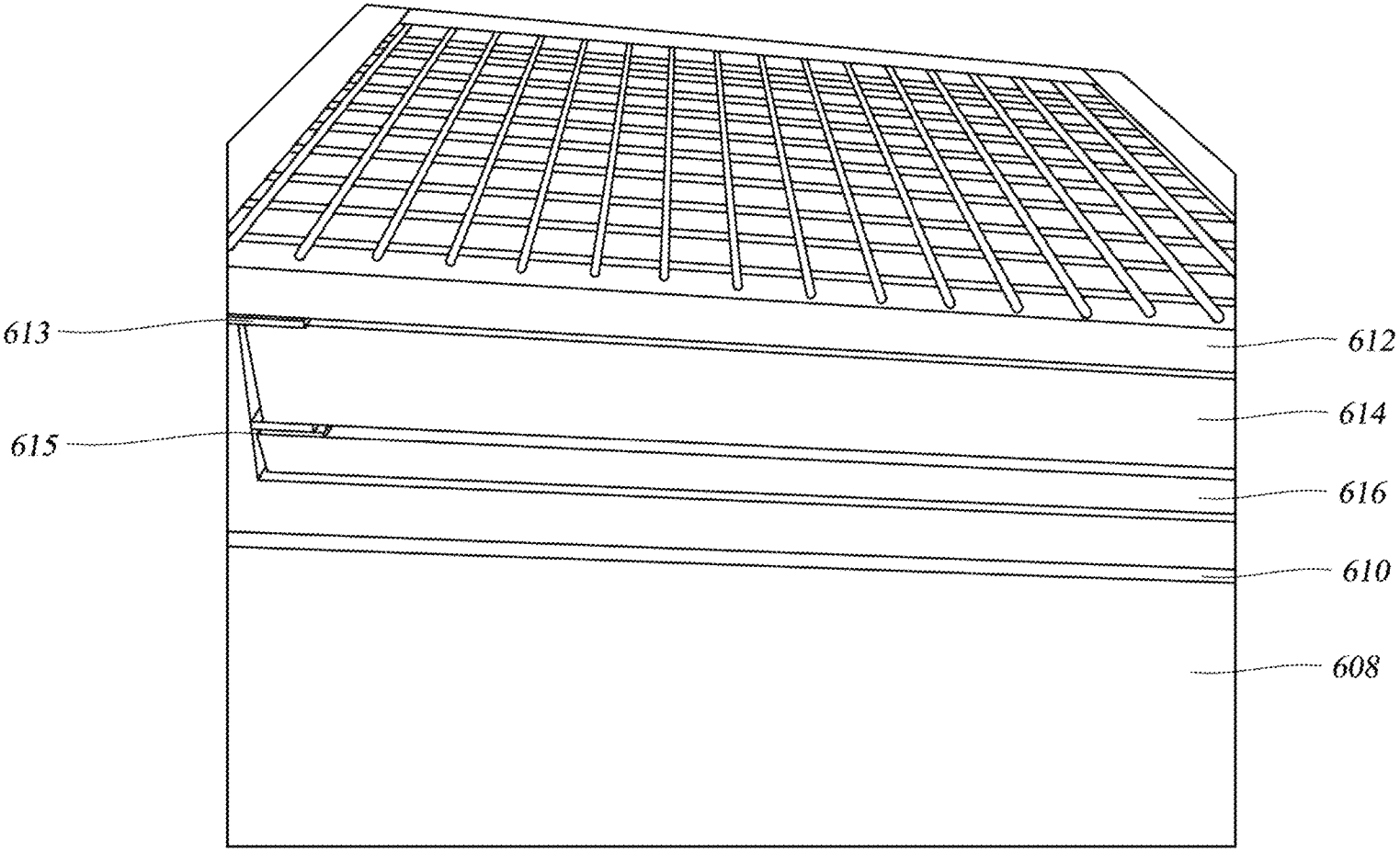
Figure 6C:
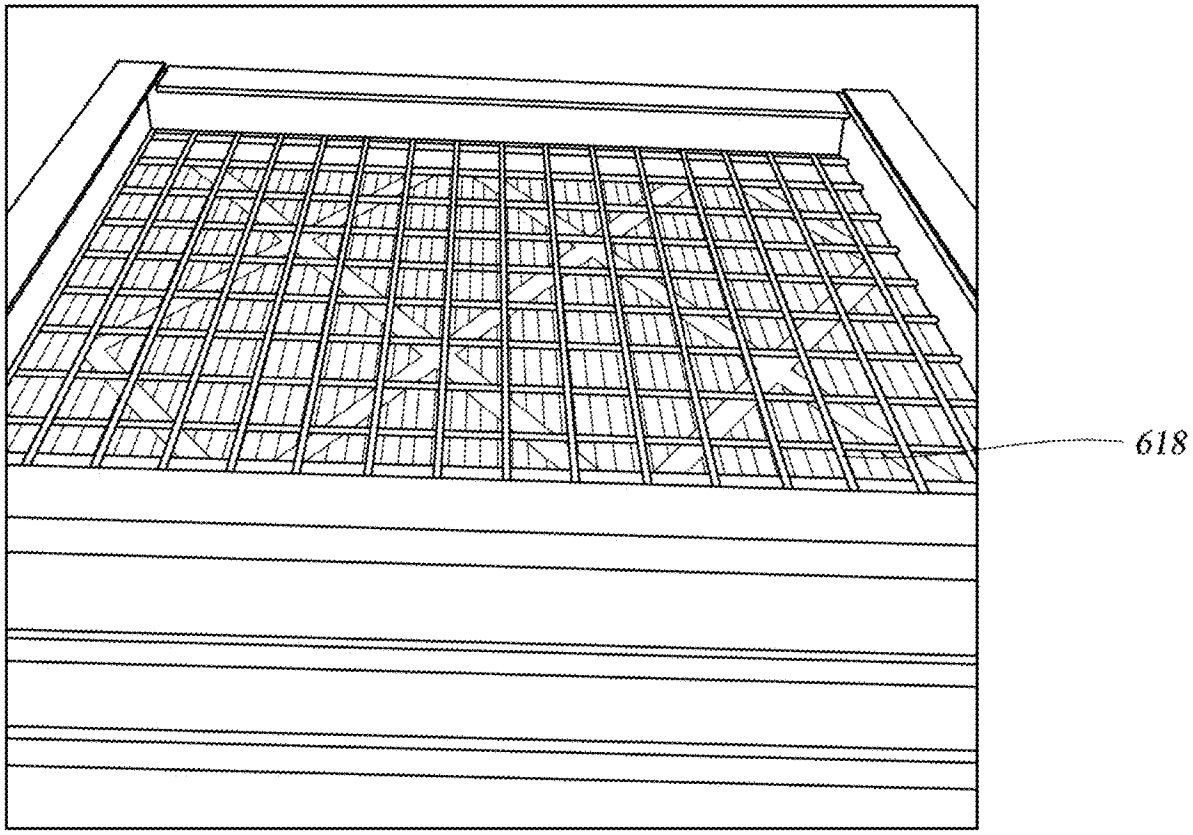

The main filter housing 110 may be configured to removably receive a main filter (e.g., a one or more filters) to filter a first portion of environmental air 112 and pass the filtered air to the at least one cavity via a main inlet 426 (e.g., as illustrated in FIG. 4D). Generally, the main filter housing 110 may be a cuboid shape that is generally rectangular with a height to receive the one or more filters in an ordered arrangement (e.g., as illustrated in FIG. 6A-6C). Generally, the one the more filters of the main filter may include at least one of a pre-screen, a charcoal filter, or one or more MERV filters. Details of the one of more filters and the ordered arrangement thereof are discussed below with respect to FIGS. 6A-6C.

The main inlet 426 may be positioned on an opposite end of the base 108 from the centrifugal fan 109. The main inlet 426 may be positioned on a bottom of the base 108 so that the first portion of environmental air 112 is drawn into the at least one cavity via the main inlet 426 in a vertical direction through the one or more filters of the main filter housing 110. The main inlet 426 may be formed in the bottom of the base 108 by walls 412-416 (e.g., as illustrated in FIG. 4B), cover 418 (e.g., as illustrated in FIG. 4C), and rack holder 420 (e.g., as illustrated in FIG. 4D) creating a seal between the sealed interior volume of the base 108 and the main filter housing 110.

The bypass inlets 116 may be openings in the walls 412-416 of the base 108 on respective lateral (e.g., left and right) sides. The bypass inlets 116 may receive a rack filter 802 (e.g., as illustrated in FIGS. 8A-8D) in rack holder 420 to filter a second portion of environmental air 118 and pass the filtered air to the at least one cavity. For instance, the bypass inlets 116 may be positioned on an opposite end of the base 108 from the centrifugal fan 109. As an example, the bypass inlets 116 may be generally triangular, so that generally triangular rack filters 802 may be inserted through the bypass inlets 116. The generally triangular rack filters 802 can be configured to create an airtight or substantially airtight seal with the structure of the bypass inlets 116. Moreover, the bypass inlets 116 may be positioned in a corner opposite the centrifugal fan 109, as the centrifugal fan 109 may (in the case of no bypass inlets 116 and rack filter 802) create a dead zone of filtered air in the at least one cavity due to vortices in the circular motion from the main inlet 426 to the first opening of the centrifugal fan 109. In this manner, the bypass inlets 116 and the rack filter 802 may increase the volumetric flow rate of filtered air, while avoiding a dead zone of filtered air in the at least one cavity. The rack filter 802 may be a MERV 13 level triangulated pocket filter. In some embodiments, the bypass inlets 116 may also draw air over the motor 114, thereby cooling the motor 114.

Figure 4E:
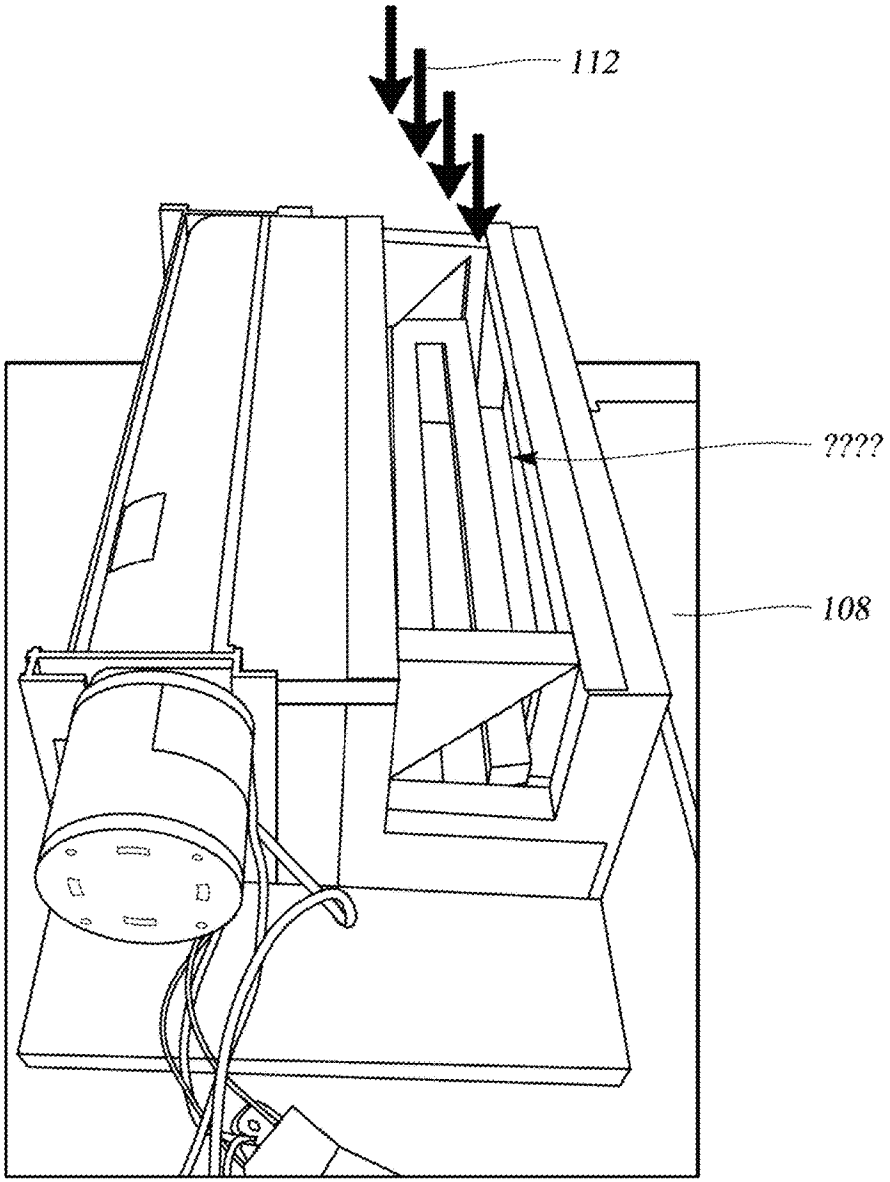

In some embodiments, the main filter housing 110 may be omitted (e.g., as illustrated in FIG. 4E), so that unfiltered air is received in the at least one cavity. In this case, the airfield 106A may still operate to reduce transmission of particulates as the airfield 106A may have an airspeed high enough to redirect unfiltered air from one zone of space to not enter another zone of space. For instance, this may reduce construction and operational cost of the airfield generator 101, while still providing a reduction in transmission of particulates between each zone of space. For instance, as a result of filtering the environmental air using only the bypass inlets 116 with the rack filter 802 and generating an airfield 106A, each zone of space may have reduced transmission of unfiltered air and reduce the effective social distance between different groups in each zone.

Figure 5A:
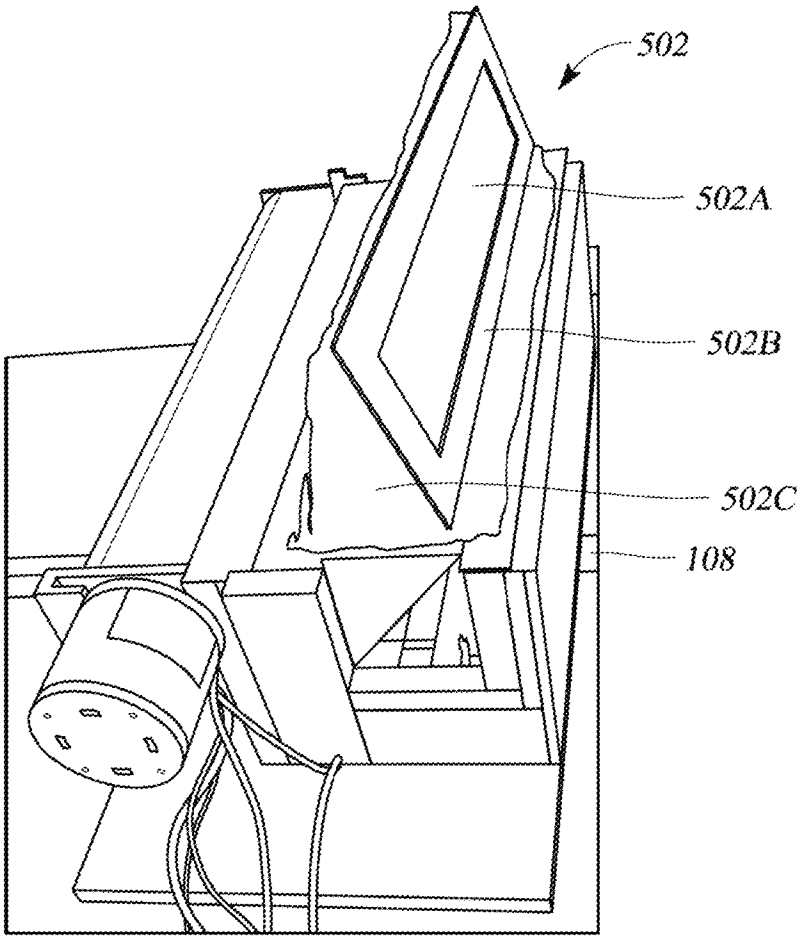

In some embodiments, the main filter housing 110 may be omitted for a polygonal filter 502 (e.g., as illustrated in FIG. 5A). In this case, the environmental air may be filtered but not as thoroughly as if the main filter housing 110 was used. For instance, this may reduce construction and operational cost of the airfield generator 101, while still providing filtered air to the at least one cavity. The airfield 106A may have an airspeed high enough to redirect unfiltered air from one zone of space to not enter another zone of space. Therefore, in this case, the particulates may be both filtered out of the air to be used as the airfield 106A (thereby reducing particulates in the environment) and redirected so as not interact with a different zone of space. For instance, as a result of filtering the environmental air using the polygonal filter 502 and the bypass inlets 116 with the rack filter 802 and generating an airfield 106A, each zone of space may have reduced transmission of unfiltered air and reduce the effective social distance between different groups in each zone.

In some embodiments, the main filter housing 110 may be used to provide a higher level of filtration of the unfiltered air than using the polygonal filter 502. While this may cost more to construct and operate than the previous two embodiments, the increase in filtration may enable indoor activities with reduced transmission of particles between the zones of space. For instance, as a result of filtering the environmental air using the main filter housing 110 and the bypass inlets 116 with the rack filter 802 and generating an airfield 106A, each zone of space may have reduced transmission of unfiltered air and reduce the effective social distance between different groups in each zone.

In some embodiments, the main filter housing 110 and/or the polygonal filter 502 may be removably engaged with the base 108, so that a user of the airfield generator 101 may remove the main filter housing 110 and/or the polygonal filter 502. For instance, the main filter housing 110 and/or the polygonal filter 502 may be interchangeable to interface with the main inlet 426, or omitted entirely. Each of the main filter housing 110 and the polygonal filter 502 may have engagement mechanisms that correspond to an engagement mechanism on the base 108. For instance, the user may modify the configuration depending on application. Moreover, the one or more filters of the main filter housing 110 may be replaced with a same or different filters, depending on application. For example, for a first application if the user wants a high level of airflow or high air speed through the outlet 104, and a high level of filtration of air is not important for the first application, the user may replace the one or more filters of the main filter housing 110, the polygonal filter 502, and/or the rack filter 802 with alternative one or more filters of the main filter housing 110, the polygonal filter 502, and/or the rack filter 802 with a lower MERV rating to increase the level of airflow or air speed of the airfield generator 101. For a second application, if a high level of filtration is important, and the level of airflow or air speed through outlet 104 is not important for the second application, the user may replace the one or more filters of the main filter housing 110, the polygonal filter 502, and/or the rack filter 802 with alternative one or more filters of the main filter housing 110, the polygonal filter 502, and/or the rack filter 802 with a higher MERV rating to increase the level of filtration of the airfield generator 101. Furthermore, the one or more filters of the main filter housing 110, the polygonal filter 502, and the rack filter 802 may be removable to clean the various filters to ensure proper filtration.

In some embodiments, the airfield generator may have a housing, a filter system, and a motor. The housing may include: a base comprising an air intake, an internal cavity providing an air passage through the base, and a filter housing, the filter housing being within the air passage; and an outlet. The outlet can comprise an opening (e.g., an upwardly directed opening) configured to generate an airfield, the outlet being in fluid communication with the air passage of the base. The outlet can extend between a first side of the housing and a second side of the housing. The filter system may be engageable with the housing. The filter system may be configured to filter air passing through the airfield generator via the air passage. The motor may be positioned at least partially within the internal cavity. The motor may be configured to generate an air flow from an ambient environment surrounding the airfield generator, through the filter system, and out of the airfield generator via the outlet of the housing thereby generating an airfield. The airfield generated by the outlet may provide a barrier between a first side of the airfield and a second side of the airfield. The airfield may be configured to inhibit passage of aerosol particles through the airfield from the first side of the airfield to the second side of the airfield. Moreover, the housing may include a first engagement mechanism. The filter system may include a second engagement mechanism. The first engagement mechanism may be configured to removably receive the second engagement mechanism to removably engage the filter system with the housing.

In some embodiments, the filter system may include a plurality of filters. At least one of the filters may be insertable into the filter housing to filter the air through the air intake and at least another filter may be insertable into the filter system to filter a separate portion of air. In some embodiments, the plurality of filters may include at least a first filter having a first parameter and at least a second filter having a second parameter. The first parameter may be different than the second parameter. The first parameter and the second parameter comprise at least one of a filter size, a filtering capacity, or a filter shape. A filter size may indicate a weight or volume of the filter (e.g., in standard sizes or as physical attributes). Filter capacity may indicate a property of the filter to remove a certain percentage of particulates at various cubic feet per minute. For example, a filter capacity may be a filter's ability to capture particles of various sizes, such as at least 0.3 microns, at least 1 microns, at least 3 micros, etc. For instance, filter capacity may be indicated by a MERV rating, such as MERV 1, 2, 3, 4, 5, 6, 7, 8, 9, 10, 11, 12, 13, 14, 15, or 16. It will be understood that any component of any filter or filter system described herein may comprise any type of filter described herein or any combination thereof.

In some embodiments, the first filter may be configured to fit within the housing and may be configured to filter air traveling into the base through the air intake. In some embodiments, the second filter may be configured to fit within the filter housing of the base and be configured to filter air from the air passage prior expulsion through the outlet as the airfield.

In some embodiments, the first or second filter may be a polygonal filter having a filtering portion extending along a length of the first or second filter between a proximal end portion and a terminal end portion. The proximal end portion and the terminal end portion may be a corresponding polygonal shape visible when viewed along the length of the second filter. The first or second filter may comprise at least a first side, a second side, and a third side defined by vertices of the polygonal shape, where the first side defines a first filtering surface of the filtering portion of the first or second filter, and wherein the second side defines at least a second filtering surface of the filtering portion of the first or second filter. As air passes from the base to the outlet through the first or second filter, the air flows through at least the first filtering surface and the second filtering surface of the first or second filter. The first or second filter comprises a pocket filter with a polygonal shape, such as a triangular pocket filter. For example, the polygonal shape may comprise any one of a triangle, rectangle, pentagon, hexagon, or any of shape as desired.

FIG. 2 schematically illustrates a block diagram of an airfield generator 200 in accordance with aspects of this disclosure. For instance, the airfield generator 200 may be a part of the airfield system 100, discussed above. As depicted in FIG. 2, the airfield generator 200 may include one or more of a main filter 204, a rack filter 206, at least one cavity 208, a fan 210 (also called a blower), an outlet 212, a controller 216, sensor(s) 218, sanitation system 220, or any combination thereof. The airfield generator 200 may take in environmental air 202 and output an airfield of filtered air 214, so as to generate at least two zones of space separated by the airfield of filtered air 214. In operation, respective portions of environmental air 202 may be received by and filtered by the main filter 204 and the rack filter 206, respectively. The filtered air may be directed into the at least one cavity 208 to be gathered in a sealed interior and received by the fan 210. Fan 210 may compress the received filtered air and output the compressed air to the outlet 212. The outlet 212 may output the airfield of filtered air 214, so as to generate at least two zones of space separated by the airfield of filtered air 214.

The controller 216 may control the fan 210, based on data from the sensor(s) 218 and/or user inputs. For instance, the controller 216 may cause the fan 210 of the airfield generator 200 to turn on or turn off in response to a user input or a signal from one of the sensor(s) 218. For instance, a first sensor of the sensor(s) 218 may monitor a temperature of a motor of the fan 210 (such as motor 114), a second sensor of the sensor(s) 218 may monitor a current or voltage draw of the motor, a third sensor of the sensor(s) 218 may monitor a volumetric flow rate of the filtered air or of airfield of filtered air 214, and/or a fourth sensor of the sensor(s) 218 may monitor a filter status of the main filter 204 and/or the rack filter 206. The controller 216 may receive data from the sensor(s) 218 and determine (based on arbitrarily complex conditions, generally referred to as "error conditions" indicating "errors") to issue alerts (such as replace filter(s)) or turn on or off the fan 210.

Figure 2B:
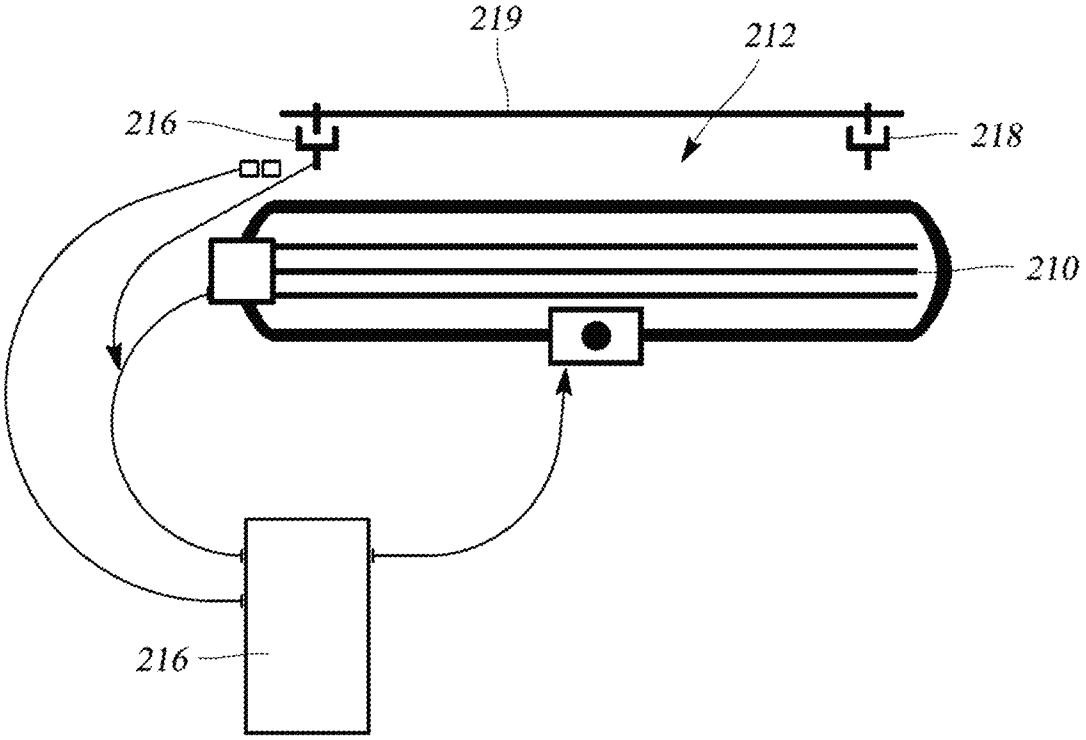
FIG. 2B depicts a subsystem of airfield systems in accordance with aspects of this disclosure.

As shown in FIG. 2B, the sensors 218 may be a kill switch and the outlet 212 may include a grate 219. The grate 219 may have one or more portions that interact with the sensors 218 when the grate 219 is placed on the outlet 212 so the sensors 218 may detect whether the grate 219 is on the outlet 212. In this way, when the sensors 218 do not detect the grate 219 is on the outlet 212, the controller 216 may receive data from the sensors 218 indicating that there is no grate 219 on the outlet 212 and the controller 216 may turn off the fan 210 or cut off power to the fan 210. When the sensors 218 detect the grate 219 is on the outlet 212, the controller may receive data from the sensors 218 indicating that the grate is on the outlet 212 and the controller may turn on the fan 210 or send power to the fan 210. During operation of the airfield generator 200, removal of the grate can result in stoppage of the fan 210, such as due to a hardwired electrical connection or a command from the controller 216.

Moreover, the controller 216 may control the sanitization system 220 to perform additional air sanitization. For instance, the controller 216 may periodically (such as every set period of time) or continuously, cause the sanitization system 220 to perform air sanitization. The sanitization system 220 may be a UV sterilization system within a sealed enclosure of the airfield generator 200. For instance, the sanitization system 220 may include one or more UV sterilization systems, and the one or more UV sterilization systems may be in the at least one cavity 208, adjacent to the fan 210, adjacent to the main filter 204, and/or adjacent to the rack filter 206 to perform air sanitization in addition to the main filter and the rack filter. One of skill the art would recognize that the one or more UV sterilization systems may direct UV light to one or several of the at least one cavity 208, the fan 210, the main filter 204, and the rack filter 206 at a same time, therefore reducing cost while ensuring filtered environmental air (or unfiltered portion of environment air when the main filter or polygonal filter is not included) is sanitized.

Generally, the controller 216 may have a user interface. The user interface may display information to users (e.g., status, data, etc.) of the airfield generator 200 and receive user inputs to control operations of the airfield generator 200 or multiple airfield generators 200. One of skill in the art would recognize that the controller 216 may be a computer, micro-controller, etc. that executes software using a memory (storing data and instructions on a non-transitory compute readable medium) and a processor to execute the instructions to perform the various operations described herein.

B. Example Control Process

Figure 3:
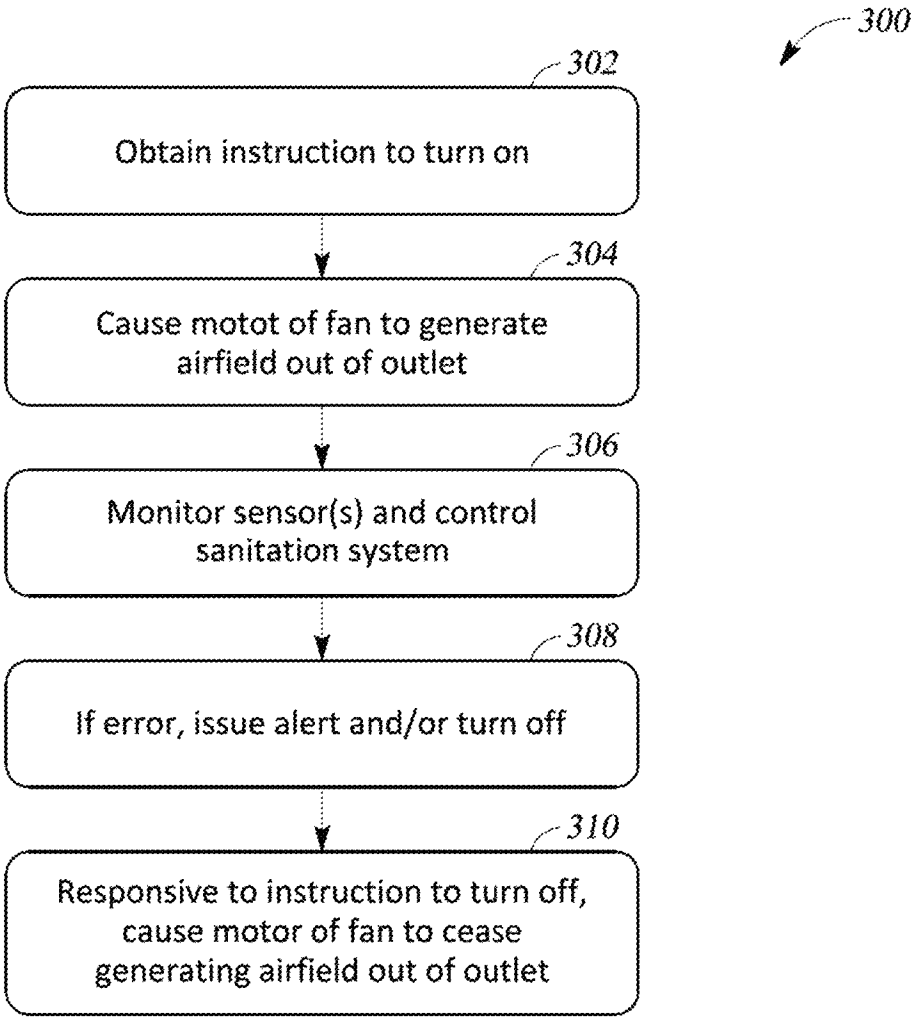
FIG. 3 depicts a flowchart illustrating a process of controlling an airfield generator in accordance with aspects of this disclosure.

FIG. 3 depicts a flowchart illustrating a process 300 of controlling an airfield generator in accordance with aspects of this disclosure. For instance, the airfield generator may be a part of the airfield system 100 or 200, discussed above. The operations of the process 300 may be performed by a controller, such as controller 216. As depicted in FIG. 3, the operations of the process 300 may start by receiving an instruction to turn on (Block 302). For instance, the controller may receive a user input or sensor signal indicating an instruction to turn on.

The controller may then proceed to cause a motor of a fan to generate an airfield out of an outlet (Block 304). For instance, the controller may transmit an instruction to the motor 114 to turn on and cause impellers 706 to rotate at an RPM to thereby draw environmental air 112 and 118 through various filters, such as the rack filter 802 and main filter of the main filter housing 110, compress the filtered are, and output the airfield via the outlet 104.

The controller may then proceed to monitor sensors and control a sanitization system (Block 306). For instance, the controller may monitor the sensor(s) 218 to determine whether errors conditions are satisfied or not and control the UV sterilization systems to perform additional sterilization (on filtered or unfiltered air when the main filter or the triangular filter is not included).

The controller may then proceed to, if an error is detected, issue an alert and/or turn off (Block 308). For instance, the controller may determine an error condition is satisfied based on sensor data and determine whether to issue an alert or turn off based on policies. For instance, if an error condition is not considered dangerous but preferred to be resolved (e.g., replace filters), the controller may issue an alert. On the other hand, if a motor temperature or an absence of the grate 219 (or some arbitrary complex conditional) indicates a dangerous circumstance, the controller may determine an instruction to turn off the motor.

The controller may then proceed to, responsive to an instruction to turn off, cause the motor of the fan to cease generating the airfield out of outlet (Block 310). For instance, the controller may receive a user input to turn off or determine a dangerous condition (and thereby determine an instruction to turn off), and send an instruction to the motor to turn off.

C. Example Subsystems

FIGS. 4A-4E, 5A-5B, 6A-6C, 7, 8A-8D, and 9A-9D depict subsystems of airfield systems 100, 200, or 300 in accordance with aspects of this disclosure. For ease of reference, the following description will refer to features of airfield system 100, but one of skill in the art would recognize that the features are applicable to airfield systems 200 or 300 as well.

FIG. 4A depicts the first portion of environmental air 112, the second portion of environmental air 118 (on one lateral side), and the airfield 106A of the airfield system 100, without the structure 102. Generally, the volumetric flow rate of the first portion of environmental air 112 and the second portion of environmental air 118 (from both lateral sides) may correspond to the volumetric flow rate of the airfield 106A. Moreover, due to the relative differences in inlet areas of the bypass inlets 116 and the main inlet 426, the volumetric flow rate of the first portion of environmental air 112 and the volumetric flow rate of the second portion of environmental air 118 (from both lateral sides) may not be substantively similar. Instead, the volumetric flow rate of the first portion of environmental air 112 may be a substantial proportion of the volumetric flow rate of the airfield 106A. Therefore, the main filter may filter a substantial portion of the volumetric flow rate of the airfield 106A. As the main filter can be composed of larger filters in both thickness and geometric shape (thereby, increasing surface area for filtering) and more filter layers (generally), the effective MERV level of the main filter may be higher, and in some embodiments substantially higher, than the rack filter. Therefore, the effective MERV level of the airfield system 100 may be greatly improved, with respect to the rack filter 802 alone, as a MERV level of system is based on (upstream versus downstream) rate of filtering at a specific volumetric flow rate. Therefore, in certain embodiments, certain versions of the main filter may be used to achieve a certain MERV level, while certain versions of the main filter, the polygonal filter 502, or no main filter are used, based on circumstances to achieve different MERV levels.

FIG. 4B depicts the base 108 without cover 418 (see FIG. 4C) and rack holder 420 (see FIG. 4D). In particular, FIG. 4B illustrates the walls 412-416, a first cavity 406 and a second cavity 408, in relation to the centrifugal fan 109 to define the sealed interior volume of the base 108. Generally, the walls 412-416 include a first and second side walls 412 and 414, which may have the bypass inlets 116, and an end wall 416. The end wall 416 may be on an opposite end of the base 108 from the centrifugal fan 109. The first and second side walls 412 and 414 and the end wall 416 may define the structure of the base 108 and ensure sealing to the centrifugal fan 109, the cover 418, and the rack holder 420. The first and second side walls 412 and 414 may ensure sealing between the interior volume along an interface with the shroud of the centrifugal fan 109 and the first and second side walls 412 and 414.

The second cavity 408 may generally correspond to the main inlet 426 and the bypass inlets 116. For instance, the second cavity may accommodate the rack filter 802 and allow the first portion of environmental air 112 to mix with the second portion of environmental air 118 before they enter the first cavity 406. The first cavity 406 may be provided to allow for filtered air to enter the first opening in the shroud of the centrifugal fan 109. Therefore, the first cavity 406 may have a defined gap between the first opening in the shroud and the second cavity 408.

FIG. 4C depicts the cover 418 covering the first cavity 406. The cover 418 may seal the interior volume along an interface with the shroud of the centrifugal fan 109 and the walls 412-416, for instance the first and second side walls 412 and 414. The cover 418 may extend from the centrifugal fan 109 to the main inlet 426.

FIG. 4D depicts the rack holder 420. The rack holder 420 may include structure 422 and support rails 424. The structure 422 may support the support rails 424 and ensure sealing around the bypass inlets 116 and the walls 412-416. Generally, the structure 422 and the support rails 424 may define the bypass inlets 116 to accommodate the rack filter 802 and provide structural support to fix the rack filter 802 during operation of the airfield system 100.

FIG. 4E depicts the main inlet 426. In particular, the main inlet 426 may be formed in the structure 422 of the rack holder 420. Notably, the main inlet 426 may be unblocked by the rack filter 802 within the interior volume. The rack filter 802 may be configured to reduce or avoid vortices in the circular motion from the main inlet 426 to the first opening of the centrifugal fan 109, such as by the rack filter 802 having a triangular shape. Other shapes are contemplated too, such as rectangular, pentagonal, hexagonal, etc. Moreover, the main inlet 426 may be spaced apart (in the z direction) from the rack filter 802 in accordance with a height of the walls 412-416 and the support rails 424, so as to not interfere with the vortices in the circular motion from the main inlet 426 to the first opening of the centrifugal fan 109.

FIG. 5A depicts the polygonal filter 502 covering the main inlet 426. The polygonal filter 502 may be a triangulated pocket filter or other polygonal shape. The pocket filter may be configured (e.g., by having a triangulated shape) to allow the filter to expand through pockets thereof to increase surface area to increase filtering surface area, versus a fixed shape filter of similar dimensions. The polygonal filter 502 may consist of MERV 13 filter formed into a triangular shape that generally extends along an axial direction of impellers 706, so that unfiltered air may pass through the filter into the second cavity 408.

The polygonal filter 502 may include a structure 502B and a triangular filter having axial filter portion(s) 502A and an end filter portion 502C. The structure 502B may provide a rigid exterior portion of the polygonal filter 502 with one or more openings to accommodate the axial filter portion(s) 502A and the end filter portion(s) 502C, to thereby filter environmental air passing through the one or more openings. The structure 502B may be made of cardboard, plastic, metal, or other suitable materials, or combinations thereof. The axial filter portion(s) 502A and the end filter portion(s) 502C may be unitary in construction (e.g., a filter formed into a triangular cylinder shape with proximal and terminal ends made of filter material), to seal each of the one or more openings of the polygonal filter 502 and to filter air moving therethrough. In this manner, construction of the filter may be easier (by avoiding internal adhesion for each filter portion to each opening and coordination thereof) but may be more costly as portions of filter not adjacent to the one or more openings may provide only partial filtering efficiency (e.g., as they are adjacent to the structure 502B). Alternatively, the axial filter portion(s) 502A and the end filter portion(s) 502C may be separate pieces of filter fixed to the structure 502B to seal each of the one or more openings of the polygonal filter 502 and to filter air moving therethrough. In this manner, less filter material may be used, but construction complexity may be increased.

In some embodiments, each axial filter portion 502A may correspond to an axially extending opening on a surface of the structure 502B of the polygonal filter 502. The axial filter portion(s) 502A (and the corresponding openings associated therewith) may form a filtering portion of each face of the polygonal filter 502. The structure 502B may form a non-filtering portion of each face of the polygonal filter 502. Generally, the filtering portion of each face may be smaller, equal to, or larger than a non-filtering portion of each face of the polygonal filter 502. In particular, a ratio of the filtering portion of each face to the non-filtering portion of each face is equal to or at least about: 30:1, 20:1, 15:1, 10:1, 15:2, 5:1, 5:2, ratios between the aforementioned ratios. As noted above, each axial filter portion 502A may expand through (e.g., in a radially outward manner) or expand away (e.g., in a radially inward manner) from its respective axially extending opening on the surface of the structure 502B of the polygonal filter 502. In this manner, each axial filter portion 502A may increase an effective filter surface area, to thereby increase filtering capacity polygonal filter 502.

The end filter portion(s) 502C may correspond to proximal and terminal open ends of the polygonal filter 502. The end filter portion 502C may provide additional filtering surface area for the polygonal filter 502, as environmental air may pass through the end filter portion 502C separately from the axial filter portion 502A.

In some embodiments, the polygonal filter 502 may include a first side, a second side, and a third side defined by vertices of the polygonal shape, where the first side defines a first filtering surface using a first axial filter portion 502A, and where the second side defines at least a second filtering surface using a second axial filter portion 502A. The third side may or may not include additional filter portions and may be designed to face the main inlet 426. In this manner, the first and second sides may provide at least a certain amount of filtering, while the third side may provide an outlet of the polygonal filter 502 to the main inlet 426. In the case that the third side also has additional filter portions, the third side may filter the air filtered by the first and second sides before entering the main inlet 426, thereby increasing an effective MERV rating of the polygonal filter 502 (but also increasing a pressure requirement on the motor 114).

In some embodiments, the filter 502 may comprise a triangulated pocket filter. The triangulated pocket filter may advantageously provide for a higher efficiency filtration system relative to alternative designs (e.g., a pleated filter system). In some embodiments, the filter 502 may comprise any polygonal shape suitable. For example, the polygonal shape may comprise any one of a triangle, rectangle, pentagon, hexagon, or any of shape as desired. As a particular example, the filter 502 may be an isosceles triangle with the first and second sides having a same length, and the third side having a length corresponding to the main inlet 426 (e.g., to cover the main inlet 426 and provide for engagement mechanisms of filter 502 corresponding to the engagement mechanism on the base 108).

Figure 5B:
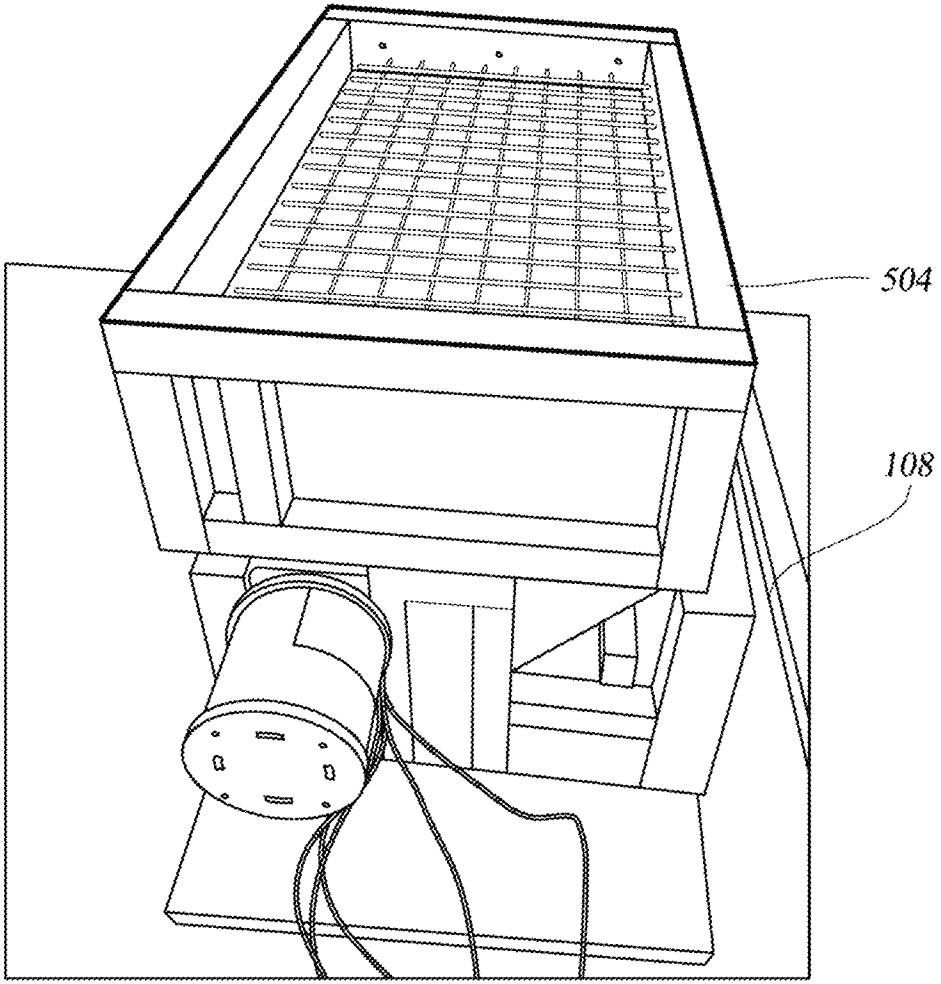

FIG. 5B depicts a main filter 504 covering the main inlet 426 to filter the first portion of environmental air 112. The main filter 504 may correspond to the main filter housing 110 with one or more filters, discussed above. As depicted in FIG. 5B, there are none of the one or more filters included therein, so the interior may be seen. Details of the main filter 504 are discussed below with respect to FIGS. 6A-6C.

FIG. 6A depicts an outside of the main filter 504. As depicted in 600A, the main filter 504 includes an exterior grate 604, a pre-screen 606, and a door 608 with a hinge 610. FIG. 6B depicts the door 608 opened by the hinge 610, to expose a support 612 for exterior grate 604, a first support 613, a first filter 614, a second support 615, and a second filter 616. FIG. 6C depicts an internal separator screen 618.

The exterior grate 604 may retain the pre-screen 606 and provide a first structural interface with the environment so that pre-screen 606 and other filters are not dislodged. The exterior grate 604 may be metal or plastic and provide a large surface area for first portion of environmental air 112 to pass through the exterior grate 604. The pre-screen 606 may be a charcoal filter to pre-filter unfiltered air. The pre-screen 606 may filter out larger particulates than the first filter 614 or second filter 616.

The door 608 and the hinge 610 may operate together to hold the exterior grate 604, the pre-screen 606, the first filter 614, and the second filter 616, in place (when the door is closed), and provide access to the pre-screen 606, the first filter 614, and the second filter 616 to replace each of the pre-screen 606, the first filter 614, and the second filter 616 as operational use indicates necessary.

The support 612 for the exterior grate 604 may support the exterior grate 604 and define an opening of the door 608 when the hinge 610 opens the door 608. The exterior grate 604 may be retained by structure (see, e.g., lip of main filter 504 above exterior grate 604) and supported by the support 612 on at least one side.

The first support 613 and the second support 615 may define slots (of predetermined size) to support to first filter 614 and the second filter 616. For instance, the first support 613 and the second support 615 may be spaced apart by a set distance, such as a standard size of filters for the first filter 614 and the second filter 616. The first support 613 and the second support 615 may inform a user where to insert the first filter 614 and the second filter 616 and guide the insertion and removal of the first filter 614 and the second filter 616. The first support 613 and the second support 615 may extend a length of first filter 614 and the second filter 616 from the opening of the door 608 to an opposite side of the main filter 504, so as support or retain the first filter 614 and the second filter 616.

The first filter 614 and the second filter 616 may be a same or different MERV levels. The first filter 614 and the second filter 616 may be a same or different thicknesses. The first filter 614 and the second filter 616 may be a same lateral size (e.g., a same cross-section), so that the unfiltered air passes through both. Similarly, the pre-screen 606 may be a same lateral size (e.g., a same cross-section), as the first filter 614 and the second filter 616. For instance, the first filter 614 may be a MERV 8 filter and the second filter 616 may be a MERV 13 filter. One of skill in the art would recognize that various combinations of different MERV levels are possible, such as a MERV 8 and a MERV 8 filter, a MERV 13 and a MERV 13 filter, etc.

The internal separator grate 618 may be positioned behind support 612 for the exterior grate 604 to provide a zone of space for pre-filtered air to gather before passing through the first filter 614 and the second filter 616. The internal separator grate 618 may be metal or plastic and provide a large surface area for first portion of environmental air 112 to pass through the internal separator grate 618.

FIG. 7 depicts noise attenuation materials 702 and 704 of the at least one cavity in view of the impellers 706 of the first opening in the shroud of the centrifugal fan 109. As discussed above, impellers 706 may compress the air (a mix of filtered and/or unfiltered, depending on configuration) to generate the airfield 106A out of the outlet 104. The noise attenuation materials 702 and 704 may line internal surface surfaces of the base 108 in the first cavity 406 and the second cavity 408. The noise attenuation materials 702 and 704 may comprise rubber that is adhesively bound to portions of the first cavity 406 and the second cavity 408.

FIGS. 8A-8D depict various rack filters, including a rack filter 802, a rack filter 804, a rack filter 806, and a rack filter 808. The rack filter 802 may include a triangulated pocket filter to allow the filter to expand through pockets thereof to increase surface area to increase filtering surface area, versus a fixed shape filter of similar dimensions. The rack filter 802 may consist of MERV 13 filter (or other MERV level filter) formed into a triangular shape that generally extends along an axial direction of impellers 706, so that unfiltered air may pass through the bypass inlets 116 and through the filter into the second cavity 408.

The rack filter 802 may include a structure 802B and a triangular filter having axial filter portion(s) 802A filtering environmental air coming into the structure 802B by end openings 802C. The structure 802B may provide a rigid exterior portion of the rack filter 802 with one or more openings to accommodate the axial filter portion(s) 802A, to thereby filter environmental air passing through the end openings 802C, through the axial filter portion(s) 802A, through the one or more openings, and into the second cavity 408. The structure 802B may be made of cardboard, plastic, metal, or other suitable materials, or combinations thereof. The axial filter portion(s) 802A may be unitary in construction (e.g., a filter formed into a triangular cylinder shape with proximal and terminal ends left open to form the end openings 802C), to seal each of the one or more openings of the rack filter 802 and to filter air moving therethrough. In this manner, construction of the filter may be easier (by avoiding internal adhesion for each filter portion to each opening and coordination thereof) but may be more costly as portions of filter not adjacent to the one or more openings may provide only partial filtering efficiency (e.g., as they are adjacent to the structure 802B). Alternatively, the axial filter portion(s) 802A may be separate pieces of filter fixed to the structure 802B to seal each of the one or more openings of the rack filter 802 and to filter air moving therethrough. In this manner, less filter material may be used, but construction complexity may be increased. In some embodiments, the axial filter portion(s) 802A may include charcoal, activated charcoal and/or activated carbon.

In some embodiments, each axial filter portion 802A may correspond to an axially extending opening on a surface of the structure 802B of the rack filter 802. The axial filter portion(s) 802A (and the corresponding openings associated therewith) may form a filtering portion of each face of the rack filter 802 that has an opening (e.g., at least one face has an opening, but one, two, or three (or more when the polygonal shape is not a triangle) may also have openings). The structure 802B may form a non-filtering portion of each face of the rack filter 802 that has an opening. The structure 802B may also form non-filtering portions on any face that does not have an opening. Generally, the filtering portion of each face of the rack filter 802 may be smaller, equal to, or larger than a non-filtering portion of each face of the rack filter 802. In particular, a ratio of the filtering portion of each face to the non-filtering portion of each face is equal to or at least about: 30:1, 20:1, 15:1, 10:1, 15:2, 5:1, 5:2, and ratios between the aforementioned ratios. As noted above, each axial filter portion 802A may expand through (e.g., in a radially outward manner) or expand away (e.g., in a radially inward manner) from its respective axially extending opening on the surface of the structure 802B of the rack filter 802. In this manner, each axial filter portion 802A may increase an effective filter surface area, to thereby increase filtering capacity rack filter 802.

The end openings 802C may correspond to proximal and terminal open ends of the rack filter 802. The end openings 802C may form a part of an air intake of the airfield generator in conjunction with the bypass inlets 116, so environmental air may pass through the end openings 802C and then through the axial filter portion(s) 802A.

In some embodiments, the rack filter 802 may include a first side, a second side, and a third side defined by vertices of the polygonal shape. In some embodiments, the first side defines a first filtering surface using a first axial filter portion 802A, where the second side defines at least a second filtering surface using a second axial filter portion 802A, and where the third side defines at least a third filtering surface using a third axial filter portion 802A. In this manner, the first, second, and third sides may provide respective amounts of filtering (based on airflow geometry). In some embodiments, the first side defines a first filtering surface using a first axial filter portion 802A, where the second side defines at least a second filtering surface using a second axial filter portion 802A, and the third side defines non-filtering surface (e.g., with no opening in structure 802B). In this manner, the first and second sides may provide respective amounts of filtering (based on airflow geometry). In some embodiments, the first side defines a first filtering surface using a first axial filter portion 802A, and the second side and the third side define non-filtering surfaces (e.g., with no opening in structure 802B). In this manner, the first and second sides may provide respective amounts of filtering (based on airflow geometry).

In some embodiments, the rack filter 802 may comprise a triangulated pocket filter. The triangulated pocket filter may advantageously provide for a higher efficiency filtration system relative to alternative designs (e.g., a pleated filter system). In some embodiments, the rack filter 802 may comprise any polygonal shape suitable. For example, the polygonal shape may comprise any one of a triangle, rectangle, pentagon, hexagon, or any of shape as desired. As a particular example, the rack filter 802 may be a right triangle with the first and second sides facing walls 412-416, and the third side forming a hypotenuses therebetween. Generally, as discussed herein, the rack filter 802 may be inserted into the bypass inlets 116 of airfield generator 101 and secured in place to the support rails 424 (e.g., by a foam sealing or other sealing material (not depicted) that surrounds the structure 802B between the structure 802B and the structure of the bypass inlets 116, where the sealing inhibits or prevents air from flowing into the base 108 between the structure 802B and the structure of the bypass inlets 116 and does not block the end openings 802C).

The rack filter 804, the rack filter 806, and the rack filter 808 may be alternative embodiments of the rack filter 802. For ease of reference, only differences between each will discussed, while similar structural and functional features are applicable to each.

The rack filter 804 may include a structure 804B and a triangular filter having axial filter portion(s) 804A filtering environmental air coming into the structure 804B by end openings 804C. In particular, the axial filter portion(s) 804A may be more rigid than the axial filter portion(s) 802A of rack filter 802, so that each axial filter portion 804A may expand through (e.g., in a radially outward manner) or expand away (e.g., in a radially inward manner) from its respective axially extending opening on the surface of the structure 802B to a smaller degree than the axial filter portion(s) 802A of the rack filter 802. In this manner, wear and tear (due to movement of the axial filter portion(s) 804A when pressure changes occur) may be reduced, but an increase in filtering surface may not be as large.

The rack filter 806 may include a structure 806B and a triangular filter having axial filter portion(s) 806A filtering environmental air coming into the structure 806B by end openings 806C. The rack filter 808 may include a structure 808B and a triangular filter having axial filter portion(s) 808A filtering environmental air coming into the structure 808B by end openings 808C. In particular, both the rack filter 806 and the rack filter 808 may have axial filter portions 806A, 808A and respective openings on two filtering surfaces, whereas the rack filters 802, 804 may have axial filter portions 802A, 804A on a single surface thereof. Additionally, both the rack filter 806 and the rack filter 808 may have multiple (e.g., two or more) axial filter portions 806A, 808A on each filtering surface extending axially down the surface separated from each other by portions of structure 806B, 808B, whereas rack filter 802, 804 may have continuous axial filter portions 802A, 804A.

Moreover, the rack filters 806, 808 may differ in certain respects. For instance, the rack filter 806 and the rack filter 808 may have a same or different number of axial filter portions 806A, 808A and respective openings on two filtering surfaces. The sizes (e.g., length and width of openings of the number of axial filter portions 806A, 808A) may be a same width or different. The separation spacing between the openings of the number of axial filter portions 806A, 808A may be a same separation spacing or different.

FIGS. 9A-9J depict components of a thermal control system, such as a cooling system 902, for airfield generators. For instance, the airfield system 100, 200, 300, in any of the embodiments disclosed herein, may comprise the cooling system 902 to dissipate any heat being output from one or more components of the system and/or to reduce a temperature of one or more components. As described above the bypass inlets 116 may draw air over the motor 114 and/or draw hot air away from the motor 114, thereby cooling the motor.

Figure 91:
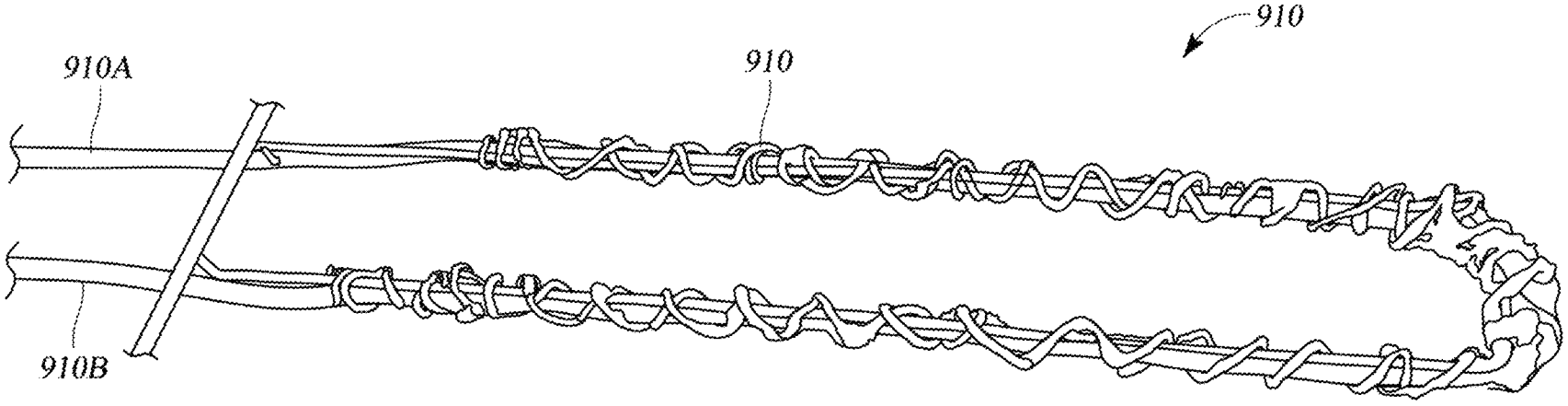

A schematic overview of the cooling system 902 is shown in FIG. 9J. The system can include one or more heat exchanges (also called heat exchangers). In some instances, the cooling system 902 may comprise a first heat exchange 904 (as illustrated in FIG. 9A-9C), a pump 908 (as illustrated in in FIGS. 9E-9H), and a second heat exchange 910 (as illustrated in FIG. 91). The first heat exchange 904 may be positioned at least partially around the motor 114 to function as a heat sink, so that heat from the motor 114 may be transferred to a coolant of the cooling system 902. The pump 908 may cause coolant within the cooling system 902 to circulate between the first heat exchange 904 and the second heat exchange 910. The second heat exchange 910 may be positioned, for example, in the first cavity 406 (as shown in FIG. 9J) to transfer heat from the coolant of the cooling system 902 to filtered air as it enters the first opening in the shroud of the centrifugal fan 109.

In some embodiments, the first heat exchange 904 may have a first inlet portion 904A, a first outlet portion 904B, and a first heat transfer portion 904C connecting the first inlet portion 904A and the first outlet portion 904B. The first inlet portion 904A may be connected to the pump 908 to receive accelerated coolant that was cooled by the second heat exchange 910. The first outlet portion 904B may be connected to the second heat exchange 910 to thereby provide heated coolant. The first heat transfer portion 904C may be a coil wound around (in a first direction (e.g., clockwise) or a second direction (e.g., counterclockwise)) an outside surface of the motor 114 one or more times (e.g., a plurality of times successively along an axially direction of the motor 114), so that heat from the motor 114 may be transferred to the coolant passing through the heat transfer portion 904C.

As shown in FIGS. 9B and 9C, the first heat transfer portion 904C may be separated from the outside surface of the motor 114 by a distance 904D so the motor 114 can vibrate without contacting the first heat transfer portion 904C. The distance 904D can be an air gap and/or void. The first heat transfer portion 904C may be coupled to the base 108 so the first heat transfer portion 904C does not contact the outside surface of the motor 114.

In some embodiments, the first heat transfer portion 904C can include an interior screen 904C-1, coil 904C-2, a first cover 904C-3, and a second cover 904C-4. The interior screen 904C-1 may be a thin sheet of material between the motor 114 and the coil 904C-2 and may increase the heat transfer from the motor 114 to the coil 904-C2. The interior screen 904C-1 may include copper, aluminum, and/or any other material suitable for heat exchange.

The coil 904C-2 may be connected to the first inlet portion 904A and the first outlet portion 904B and may be wound around the interior screen 904C-2 one or more times. The coil 904C-2 may be tubing and may transport coolant around the motor 114 from the first inlet portion 904A to the first outlet portion 904B. As the coolant passes through the coil 904C-2 the coolant may draw heat away from the motor 114 and transport the heat away from the motor 114.

The first cover 904C-3 may be wrapped around the outside of the coil 904C-2 and may keep heat from the motor 114 near the coil 904C-2 and away from the motor 114 to increase or maximize an amount of heat the coolant can transport away from the motor 114. The first cover 904C-3 may include aluminum, cooper, and/or any other material that may keep heat near the coil 904C-2.

The second cover 904C-4 may be a thin sheet of material wrapped around the first cover 904C-3. The second cover 904C-4 may be coupled to the first cover 904C-3 via a magnet or other securement mechanism. The magnet may be a magnet just strong enough to couple the second cover 904C-4 to the first cover 904-C3 such that the magnet does not affect the motor 114. The second cover 904-C4 may be an insulator designed to keep heat from escaping outside of the first cover 904-C3. The second cover 904-C4 may include Teflon or any other suitable insulating material.

The second heat exchange 910 may have a second inlet portion 910A, a second outlet portion 910B, and a second heat transfer portion 910C connecting the second inlet portion 910A and the second outlet portion 910B. The second inlet portion 910A may be connected to the first heat exchange 904 (e.g., the first outlet portion 904B) to receive heated coolant that was heated by the first heat exchange 904. The second outlet portion 910B may be connected to the pump 908 to thereby provide cooled coolant to the pump. The second heat transfer portion 910C may traverse the first cavity one or more times. For instance, the second heat transfer portion 910C may traverse the first cavity one time, two times, three times, or generally, a plurality of times. In this manner, the second heat transfer portion 910C may transfer heat from the coolant to filtered air as it enters the first opening in the shroud of the centrifugal fan 109. In some embodiments, the second heat exchange 910 may also have a plurality of protrusions 910C. The plurality of protrusions 910C of may increase a surface area of the second heat exchange 910, to increase heat transference from the coolant to the filter air. For instance, the plurality of protrusions 910C may be fins to interact with the filtered air without substantially constricting airflow into the first opening in the shroud of the centrifugal fan 109.

The pump 908 may have a third inlet portion 908A, a third outlet portion 908B, an impeller 908C, and an actuator system 908D. The third inlet portion 908A may be connected to the second outlet portion 910B of the second heat exchange 910 to receive cooled coolant from the second heat exchange 910. The third outlet portion 908B may be connected to the first inlet portion 904A of the first heat exchange 904 to provide accelerated, cooled coolant to the first heat exchange 904. The impeller 908C may accelerate the coolant received by the third inlet portion 908A in accordance with the actuator system 908D.

The actuator system 908D may cause the impeller 908C to rotate to thereby accelerate the coolant. For instance, the actuator system 908D may be an inductive coil (e.g., a 120 volt alternating current coil) that is placed adjacent (e.g., substantially aligned with and near to) a magnet 908C-1 of the pump 908. The magnet 908C-1 may be attached by a spindle 908C-2 (e.g., made of plastic) to the impeller 908C, to thereby cause the impeller 908C to rotate in accordance with rotation of the magnet. The inductive coil may cause the magnet 908C-1 to rotate in accordance with electricity being applied to the inductive coil. In this manner, the coolant circuit (e.g., sequentially through each of the pump 908, the first heat exchange 904, the second heat exchange 910, and back to the pump 908) may be sealed from external actuation. The impeller 908C may be located within a coolant housing 908E within a path of the coolant.

In some embodiments, the coolant may be driven by a heat engine effect (e.g., thermodynamic gradient causing circulation). In various systems, the impeller 908C and the actuator system 908D may be omitted if the motor 114 is regulated to avoid outputting substantial heat.

Alternatively, the actuator system 908D may be selectively activated to induce the motion of the impeller 908C if the motor 114 is not currently outputting substantial heat. For instance, the controller 216 may monitor a temperature of the motor 114 (or an indication thereof, such as current drawn thereby) and control the actuator system 908D to reduce circulation time, to thereby increase heat transference. Alternatively, the actuator system 904D may be constantly activated (when the generator 101 is turned on), as the heat transference away the motor 114 may be necessary to regulate the temperature thereof. In this case, the controller 216 may be used to constantly activate the actuator system 904D, or the actuator system 904D may be directly hardwired to an electricity source of the generator 101 without the controller 216 controlling the actuator system 904D.

In other embodiments, the first heat exchange 904 may instead have a different configuration. For instance, as illustrated in FIG. 9D, the first heat exchange 904 instead be a third heat exchange 906. The third heat exchange 906 may include a fourth inlet portion 906A, a fourth outlet portion 906B, and a third heat exchange portion 906C. The fourth inlet portion 906A may correspond to the first inlet portion 904A of the first heat exchange 904, as described above. The fourth outlet portion 906B may correspond to the first outlet portion 904B of the first heat exchange 904, as described above. The third heat exchange portion 906C may be a coil wound around an outside surface of the motor 114, so that heat from the motor 114 may be transferred to the coolant passing through the heat transfer portion 906C.

The third heat exchange portion 906C may include a plurality radial portions 906C-1, a plurality of axial portions 906C-2, and a plurality of circumferential portions 906C-3. Each axial portion 906C-2 may extend from a proximal end portion of the motor 114 to a terminal end portion of the motor 114. Each radial portion 906C-1 may extend radially outward then extend radially inward while extending circumferentially about a circumference defined substantially by the outer surface of the motor 114. Each circumferential portions 906C-3 may extend circumferentially about the circumference while extending in a first axial direction then in a second axial direction opposite the first axial direction. For instance, each circumferential portions 906C-3 may connect two axial portions 906C-2 at the proximal end portion of the motor 114, while each radial portion 906C-1 may connect two axial portions 906C-2 at the terminal end portion of the motor 114.

The third heat exchange 906 may include a plurality of struts 906D. Each strut 906D may extend between adjacent portions of the third heat exchange 906 to increase heat transference between the motor 114 and the coolant. For instance, some struts 906D may extend circumferentially about the circumference between two or more axial portions 906C-2. Other struts 906D may extend circumferentially about the circumference between end portions of a circumferential portion 906C-3 or a radial portion 906C-1.

Generally, the coolant may be any suitable fluid to transfer heat. For instance, the coolant may be a non-hydrous fluid. The coolant may be non-toxic. The coolant may have a boiling point above temperatures the motor 114 may achieve. The first heat exchange 904 second heat exchange 910 and/or third heat exchange 906 may be any appropriate material, such as copper, aluminum, etc.

Therefore, the cooling system 902 may capture heat from the motor 114 (e.g., in an enclosed environment) and increase efficiency and safety of the airfield generator 101. For instance, when the airfield generator 101 is placed in confined parameters (such as under counters or podiums), the heat from the motor 114 may be transferred to the filtered air (which is at ambient temperatures) and distributed away from the system in the airfield 106A generated by the airfield generator 101.

D. Air Flow Path

Figure 10A:
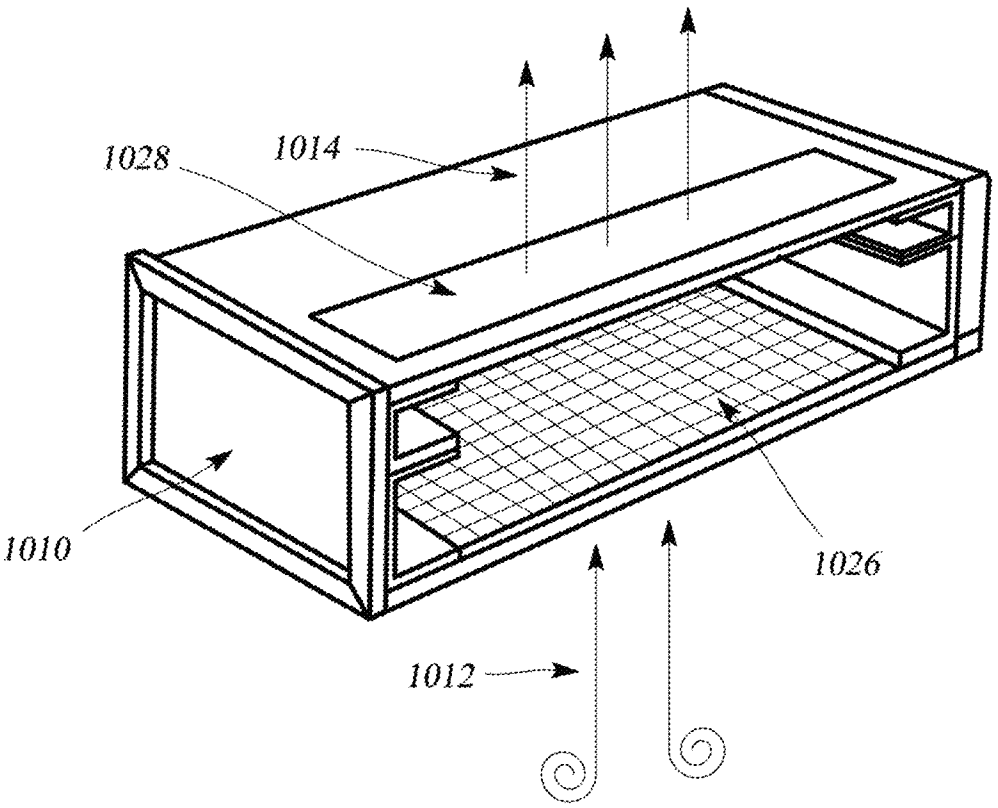
FIGS. 10A-10B depict an air flow path of an airfield generator in accordance with aspects of this disclosure.
Figure 10B:
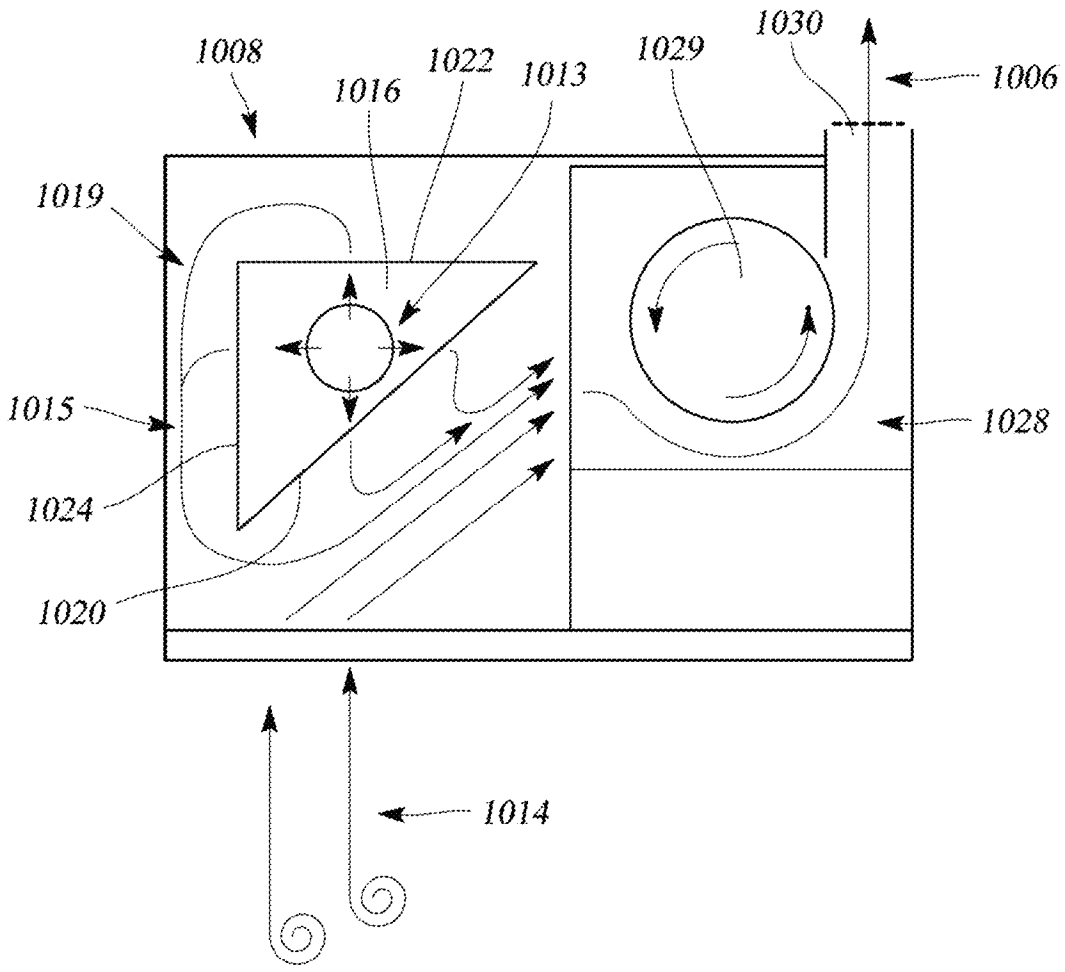

FIGS. 10A and 10B depict an air flow path of airfield systems of the disclosure. With reference to FIG. 10A, a first portion of environmental air 1012 may be drawn into a main filter housing 1010 through a main inlet 1026. The first portion of environmental air 1012 may be drawn through one or more filters 614, 616 (shown in FIG. 6B) to filter the first portion of environmental air 1012 to make a first portion of filtered air 1014. The first portion of filtered air 1014 may be drawn through a main outlet 1028 out of the main filter housing 1010.

With reference to FIG. 10B, the first portion of filtered air 1014 from the main outlet 1028 may be drawn through a secondary inlet 1030 into a base 1008. The base 1008 may include a rack filter 1016. A second portion of environmental air 1013 may be drawn into the base 1008 through one or more bypass inlets 116 (shown in FIGS. 1D and 1E) and through a rack filter 1016. The rack filter 1016 may be one or more of the rack filters 802-808. The rack filter 1016 may filter the second portion of environmental air 1013 to make a second portion of filtered air 1015. The second portion of filtered air 1015 may exit the rack filter 1016 through a first side 1020, a second side 1022, and a third side 1024. The second portion of filtered air 1015 that exits the rack filter 1016 through the second side 1022 and the third side 1024 may be drawn through a back portion 1019 of the base 1008. The second portion of filtered air 1015 that passes through the back portion 1019 may make an airflow of an airfield 1006 laminar. The second portion of filtered air 1015 and the first portion of filtered air 1014 may combine into a filtered air flow 1026. The filtered air flow 1026 may be drawn into a fan housing 1028 and forced through an outlet 1030 by fan 1029 to make the airfield 1006. The outlet may be generally vertical and/or upwardly facing (e.g., in a directional generally perpendicular to and/or away from the floor).

The first portion of environmental air 1012, the second portion of environmental air 1013 from a first of the one or more bypass inlets 116, and the second portion of environmental air 1013 from a second of the one or more bypass inlets 116 may each have different flow rates. The airfield 1006 may have a flow rate higher than the first portion of environmental air 1012, the second portion of environmental air 1013 from the first of the one or more bypass inlets 116, and/or the second portion of environmental air 1013 from the second of the one or more bypass inlets 116. For example, the first portion of environmental air 1012 may have a flow rate of less than or equal to about 230 ft/min, the second portion of environmental air 1013 from the first of the one or more bypass inlets 116 may have a flow rate of less than or equal to about 630 ft/min, and the second portion of environmental air 1013 from the second of the one or more bypass inlets 116 may have a flow rate of less than or equal to about 550 ft/min and the airfield 1006 may have a flow rate of at least about 900 ft/min.

E. Further Aspects

Generally, airfield systems of the disclosure, including airfield systems 100, 200, or 300, may be manufactured and/or assembled. For instance, a method to manufacture the airfield system 100 may include: obtaining a housing, a filter system, a motor of an airfield system, where the filter system is engageable with the housing; obtaining a plurality of filters; assembling the housing with the motor; engaging the filter system with the housing; and inserting the plurality of filters.

Moreover, airfield systems of the disclosure, including airfield systems 100, 200, or 300, may reduce the incidences of infectious disease transfer. For instance, a method to reduce the incidences of infectious disease transfer may include: receiving an instruction to operate an airfield generator of airfield systems 100, 200, or 300; and causing the motor to generate an air flow from an ambient environment surrounding the airfield generator, through the filter system, and out the outlet of the housing, thereby generating an airfield. The infectious diseases may be a common cold, influenza, and/or COVID. The infectious disease may be caused by one or more of a Rhinoviruses, Coronavirus, influenza virus types A, B, C, D, *Streptococcus pneumoniae, Haemophilus influenzae, Moraxella catarrhalis, Staphylococcus aureus*, other streptococci species, anaerobic bacteria, or gram negative bacteria.

Further, airfield systems of the disclosure, including airfield systems 100, 200, or 300, may reduce symptoms of allergy. For instance, a method to reduce symptoms of allergy may include: receiving an instruction to operate an airfield generator of airfield systems 100, 200, or 300; and causing the motor to generate an air flow from an ambient environment surrounding the airfield generator, through the filter system, and out the outlet of the housing, thereby generating an airfield. The allergy may be a seasonal allergy or a food allergy.

Airfield generators, of airfield systems 100, 200, or 300, may generate the airfield using air from at least one of the first side of the airfield, the second side of the airfield, or both. The airfield generators may reduce particulates sized 0.3 to 1 micron in the air at an efficiency of at least 75%, and particulates sized greater than 1 micron in the air at an efficiency of at least 90%, at a specific cubic feet per minute. The airfield generators may reduce incidences of infectious disease transfer. For instance, the infectious diseases may be a common cold, influenza, and/or COVID.

Many other variations than those described herein will be apparent from this disclosure. For example, certain acts, events, or functions of any of the algorithms described herein can be performed in a different sequence, can be added, merged, or left out altogether (for example, not all described acts or events are necessary for the practice of the algorithms). Moreover, acts or events can be performed concurrently, for example, through multi-threaded processing, interrupt processing, or multiple processors or processor cores or on other parallel architectures, rather than sequentially. In addition, different tasks or processes can be performed by different machines and/or computing systems that can function together.

It is to be understood that not necessarily all such advantages can be achieved in accordance with any particular example of the examples disclosed herein. Thus, the examples disclosed herein can be embodied or carried out in a manner that achieves or optimizes one advantage or group of advantages as taught herein without necessarily achieving other advantages as may be taught or suggested herein.

The various illustrative logical blocks, modules, and algorithm steps described in connection with the examples disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The various illustrative logical blocks and modules described in connection with the examples disclosed herein can be implemented or performed by a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be a controller, microcontroller, or state machine, combinations of the same, or the like. A processor can include electrical circuitry or digital logic circuitry configured to process computer-executable instructions. In another example, a processor can include an FPGA or other programmable device that performs logic operations without processing computer-executable instructions. A processor can also be implemented as a combination of computing devices, for example, a combination of a DSP and a microprocessor, a plurality of microprocessors, one or more microprocessors in conjunction with a DSP core, or any other such configuration. A computing environment can include any type of computer system, including, but not limited to, a computer system based on a microprocessor, a mainframe computer, a digital signal processor, a portable computing device, a device controller, or a computational engine within an appliance, to name a few.

The steps of a method, process, or algorithm described in connection with the examples disclosed herein can be embodied directly in hardware, in a software module stored in one or more memory devices and executed by one or more processors, or in a combination of the two. A software module can reside in RAM memory, flash memory, ROM memory, EPROM memory, EEPROM memory, registers, hard disk, a removable disk, a CD-ROM, or any other form of non-transitory computer-readable storage medium, media, or physical computer storage known in the art. An example storage medium can be coupled to the processor such that the processor can read information from, and write information to, the storage medium. In the alternative, the storage medium can be integral to the processor. The storage medium can be volatile or nonvolatile. The processor and the storage medium can reside in an ASIC.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

Some embodiments have been described in connection with the accompanying drawings. The figures are drawn and/or shown to scale, but such scale should not be interpreted as limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

F. Terminology

Terms of orientation used herein, such as "top," "bottom," "horizontal," "vertical," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations. The terms "up" and "down" (and related terms) are with reference to the pull of Earth's gravity.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

Conditional language used herein, such as, among others, "can," "might," "may," "for example," and the like, unless specifically stated otherwise, or otherwise understood within the context as used, is generally intended to convey that certain examples include, while other examples do not include, certain features, elements and/or states. Thus, such conditional language is not generally intended to imply that features, elements and/or states are in any way required for one or more examples or that one or more examples necessarily include logic for deciding, with or without author input or prompting, whether these features, elements and/or states are included or are to be performed in any particular example. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. Further, the term "each," as used herein, in addition to having its ordinary meaning, can mean any subset of a set of elements to which the term "each" is applied.

Disjunctive language such as the phrase "at least one of X, Y, or Z," unless specifically stated otherwise, is otherwise understood with the context as used in general to present that an item, term, etc., may be either X, Y, or Z, or any combination thereof (for example, X, Y, and/or Z). Thus, such disjunctive language is not generally intended to, and should not, imply that certain examples require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

G. Summary

Various embodiments and examples of airfield systems, devices, and methods have been disclosed. Although the systems, devices, and methods have been disclosed in the context of those embodiments and examples, and the above detailed description has shown, described, and pointed out novel features as applied to various examples, it will be understood that various omissions, substitutions, and changes in the form and details of the disclosed technology can be made without departing from the spirit of the disclosure. As will be recognized, the embodiments described herein can be embodied within a form that does not provide all of the features and benefits set forth herein, as some features can be used or practiced separately from others. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow.

What is claimed is:

1. An airfield generator comprising:

a housing, a filter system housing, a fan, and a cooling system, wherein the airfield generator is configured generate an airfield that inhibits passage of aerosol particles from a first side of the airfield to a second side of the airfield;

the housing comprising:

a base comprising a first air intake, a second air intake, a third air intake, and a first internal cavity providing an air passage through the base;

a first filter in the first internal cavity and configured to filter air entering the base from the second air intake and the third air intake; and a first outlet comprising an upwardly directed opening configured to generate the airfield, the first outlet being in fluid communication with the air passage of the base;

the filter system housing configured to be coupled to the first air intake, the filter system housing comprising:

a fourth air intake, a second outlet in fluid communication with the first air intake, and a second internal cavity providing an air passage through the filter system housing between the fourth air intake and the second outlet; and a second filter in the second internal cavity, the second filter configured to filter air passing through the filter system housing;

the fan comprising a motor that is positioned at least partially within the first internal cavity, the fan being configured to:

generate a first air flow from an ambient environment surrounding the airfield generator into the second air intake and the third air intake, through the first filter and the base;

generate a second air flow from the ambient environment surrounding the airfield generator into the fourth air intake, through the filter system housing and the base; and wherein the first air flow and the second airflow mix in the first internal cavity to form a combined air flow, and the fan is configured to force the combined air flow out of the airfield generator via the first outlet thereby generating the airfield; and the cooling system configured to cool the motor, the cooling system comprising a first heat exchange associated with the motor, a second heat exchange associated with the first internal cavity, and a pump;

wherein the first heat exchange is in fluid communication with the second heat exchange, and the pump is configured to circulate a fluid between the first heat exchange and the second heat exchange, and wherein the first heat exchange is configured to transfer heat from the motor to the fluid, and the second heat exchange is configured to transfer heat from the fluid to a portion of the combined air flow in the first internal cavity.

2. The airfield generator of claim 1, further comprising a support structure, wherein the housing is coupled to the support structure via one or more vibration dampeners that inhibit a transfer of vibration from the housing to the support structure.

3. The airfield generator of claim 2, wherein the support structure is a table.

4. The airfield generator of claim 1, wherein the first filter has a polygonal shape having a filtering portion extending along at least a portion of a length of the first filter between a proximal end portion and a terminal end portion.

5. The airfield generator of claim 4, wherein the first filter comprises at least a first filter side, a second filter side, and a third filter side defined by vertices of the polygonal shape, wherein the first filter side defines a first filtering surface of the filtering portion of the first filter, the second filter side defines a second filtering surface of the filtering portion of the first filter, and the third filter side defines a third filtering surface of the filtering portion of the first filter.

6. The airfield generator of claim 1, wherein the first filter comprises a triangular pocket filter.

7. The airfield generator of claim 1, wherein the second filter comprises a plurality of filters in series.

8. The airfield generator of claim 1, wherein the first outlet comprises a nozzle.

9. The airfield generator of claim 8, wherein the nozzle comprises a width that is constant along the first outlet between the first side of the housing and the second side of the housing.

10. The airfield generator of claim 8, wherein the nozzle comprises a width that varies along the first outlet between the first side of the housing and the second side of the housing.

11. An airfield generator comprising:

a housing, a filter system housing, and a fan, wherein the airfield generator is configured generate an airfield that inhibits passage of aerosol particles from a first side of the airfield to a second side of the airfield;

the housing comprising:

a base comprising a first air intake, an internal cavity providing an air passage through the base, a first filter within the air passage; and an outlet comprising an upwardly directed opening configured to generate the airfield, the outlet being in fluid communication with the air passage of the base and extending between a first side of the housing and a second side of the housing; and the fan comprising a motor positioned at least partially within the internal cavity, the fan configured to generate an air flow from an ambient environment surrounding the airfield generator, through the first filter, and out of the outlet of the housing, thereby generating the airfield.

12. The airfield generator of claim 11, further comprising a filter system configured to be coupled to the first air intake, the filter system comprising:

a filter system housing comprising:

a second air intake, a second outlet in fluid communication with the first air intake, and a second internal cavity providing air passage through the filter system housing between the second air intake and the second outlet; and one or more second filters in the second internal cavity, the one or more second filters configured to filter air passing through the filter system housing.

13. The airfield generator of claim 12, wherein the filter system comprises a triangular pocket filter.

14. The airfield generator of claim 11, further comprising a cooling system configured to cool the motor, the cooling system comprising a first heat exchange surrounding the motor, a second heat exchange at least partially within the internal cavity, and a pump;

wherein the first heat exchange is in fluid communication with the second heat exchange, and the pump is configured to circulate a fluid between the first heat exchange and the second heat exchange; and wherein the first heat exchange is configured to transfer heat from the motor to the fluid, and the second heat exchange is configured to transfer heat from the fluid to a portion of the air flow in the first internal cavity.

15. The airfield generator of claim 14, wherein the cooling system further comprises one or more sensors configured to detect a temperature of the motor and/or the fluid at one or more locations of the cooling system, and wherein the cooling system further comprises a controller configured to control a speed of the motor and/or the pump based on the temperature of the motor and/or the fluid.

16. The airfield generator of claim 14, wherein the first heat exchange comprises:

an interior screen surrounding the motor, wherein the interior screen is separated from an outer surface of the motor by a distance;

a coil surrounding the interior screen, the coil comprising a tube wound around the interior screen one or more times, the tube in fluid communication with the second heat exchange;

a first cover surrounding the coil, the first cover configured to draw heat away from the motor; and a second cover surrounding the first cover, the second cover configured to inhibit or prevent heat from escaping from an outer surface of the first cover.

17. The airfield generator of claim 11, further comprising a third air intake and a fourth air intake, wherein the motor is configured to generate a second air flow from the ambient environment surrounding the airfield generator, through third air intake, the fourth air intake, and the first filter, and wherein the second air flow enters the air flow in the internal cavity.

18. The airfield generator of claim 11, wherein the internal cavity comprises a gap between the first filter and the motor, wherein the gap is configured to hold a volume of filtered air of the air flow.

19. The airfield generator of claim 11, wherein the motor comprises a centrifugal fan positioned in the internal cavity, wherein the centrifugal fan is configured to generate the air flow.

20. The airfield generator of claim 11, wherein the outlet comprises one or more sensors configured to detect whether a grate is covering the outlet, and wherein the airfield generator further comprises a controller in communication with the one or more sensors, and the controller is configured to turn off the motor when the one or more sensors detect the grate is not covering the outlet.

* * * * *